US011825898B2

(12) United States Patent
Thrane et al.

(10) Patent No.: US 11,825,898 B2
(45) **Date of Patent: *Nov. 28, 2023**

(54) SWIMSUIT WITH LEFT-HANDED OPENING MECHANISM

(71) Applicants: Mary Jo Thrane, North Oaks, MN (US); Jane Norgard, North Oaks, MN (US)

(72) Inventors: Mary Jo Thrane, North Oaks, MN (US); Jane Norgard, North Oaks, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/349,917

(22) Filed: Jun. 17, 2021

(65) Prior Publication Data

US 2021/0307412 A1 Oct. 7, 2021

Related U.S. Application Data

(63) Continuation-in-part of application No. 15/665,384, filed on Jul. 31, 2017, now Pat. No. 11,071,332.
(Continued)

(51) Int. Cl.
*A41D 7/00* (2006.01)
*A41D 27/08* (2006.01)
*A41F 15/00* (2006.01)

(52) U.S. Cl.
CPC ..... *A41D 7/00* (2013.01); *A41D 27/08* (2013.01); *A41F 15/002* (2013.01); *A41D 2300/32* (2013.01); *A41D 2300/322* (2013.01); *A41D 2300/324* (2013.01); *A41D 2400/44* (2013.01); *A41D 2400/70* (2013.01); *A41D 2600/10* (2013.01)

(58) Field of Classification Search
CPC ..... A41D 7/00; A41D 27/08; A41D 2300/32; A41D 2300/322; A41D 2300/324; A41D 2400/44; A41D 2400/70; A41D 2600/10; A41F 15/002; B63C 11/04; A41C 1/006; A41C 1/02; A41B 13/005; A41B 13/08
USPC ..... 2/67
See application file for complete search history.

(56) References Cited

U.S. PATENT DOCUMENTS 3,023,192 A 2/1962 Chivers
3,493,972 A * 2/1970 Oldham ..... B63C 11/04 2/2.17

(Continued)

OTHER PUBLICATIONS

Buyer's Guide 2015. Cressi Sub S.p.A.. 2015 (Year: 2015).*

(Continued)

*Primary Examiner* — Aiying Zhao
(74) *Attorney, Agent, or Firm* — William J Delfs

(57) ABSTRACT

A swimsuit having a torso-covering section extending from a bustline to a hemline. The torso-covering section has a fastener on the front panel that extends from a first point on the bustline in a diagonal direction to a second point on the hemline. The torso-covering section is defined by front, back, left, and right panels. The point on the hemline is situated on an opposite side of the wearer than the point on the bustline. The fastener has a starting point situated on a wearer's leg cuff on one side of the wearer's body to an ending point on the wearer's bustline on the side of the body opposite to the leg cuff. For example, the fastener ending point is on the right leg cuff and the fastener starting point is on the bustline on the left side of the wearer.

2 Claims, 20 Drawing Sheets

Related U.S. Application Data

(60) Provisional application No. 62/369,733, filed on Aug. 1, 2016.

(56) References Cited

U.S. PATENT DOCUMENTS 3,643,264 A * 2/1972 Rector ..... A44B 18/00 2/2.17
4,464,795 A * 8/1984 Long ..... A41D 13/012 2/69
4,494,248 A * 1/1985 Holder ..... A41D 15/00 2/919
4,494,546 A 1/1985 Steiman
5,706,523 A 1/1998 Witzel
5,717,998 A 2/1998 Everett
5,806,090 A * 9/1998 Johnson ..... A41D 13/012 2/87
5,822,802 A 10/1998 Chou
5,918,310 A 7/1999 Farahany
6,185,741 B1 2/2001 Kehoe
6,219,841 B1 4/2001 Anderson
6,223,351 B1 5/2001 Marie
6,240,560 B1 6/2001 DeCaro
6,415,440 B1 * 7/2002 Stinton ..... A41D 13/012 2/2.17
6,477,712 B1 * 11/2002 Jones ..... A41D 13/02 2/456
7,260,852 B2 8/2007 Sheetz
D601,778 S 10/2009 Rance
D638,199 S 5/2011 Naylor
8,127,370 B2 3/2012 Nunn
8,281,412 B2 10/2012 Byrnes
8,286,262 B2 10/2012 Rance
8,316,464 B2 11/2012 Hersh
8,429,762 B2 4/2013 Weisman
8,819,865 B1 9/2014 Crye
D787,783 S 5/2017 Mckinney-Brown
D791,437 S 7/2017 Kabuya
2004/0078876 A1 * 4/2004 Wilson ..... A41D 13/02 2/458
2004/0128733 A1 7/2004 Hendricks
2004/0154067 A1 * 8/2004 Hutcheon ..... B63C 9/087 2/82
2007/0277278 A1 12/2007 O'Brien
2008/0216218 A1 * 9/2008 McKinney ..... A62D 5/00 2/457
2009/0126072 A1 5/2009 Allen
2013/0180024 A1 7/2013 Flick
2013/0298304 A1 * 11/2013 Ott ..... A44B 19/24 2/80
2014/0115744 A1 * 5/2014 Myerscough ..... B63C 11/04 2/2.17
2014/0196188 A1 7/2014 Brady
2015/0007374 A1 1/2015 Larson

OTHER PUBLICATIONS

Link to commercially available women's swimsuit with front zippered torso (No author or article) https://www.swimoutlet.com/p/next-good-karma-solid-malibu-zip-s-s-one-piece-swimsuit-46958/?color=9325. Retrieved Jun. 14, 2016.
Link to commercially available men's swimsuit with side zipper (No author or article). https://www.amazon.com/NDS-Wear-Sexy-Side-Swimsuit/dp/B00JJVMQA8 (First commercially available Sep. 14, 2014).
Mike Ashby, Material property data for engineering materials (Book), 2016, p. 10, 4th Edition, Grant Design Teaching Resources (https://grantadesign.com/education/), Cambridge, United Kingdom. Accessed on May 3, 2020 at URL: https://downloadfiles.grantadesign.com/pdf/booklets/Material_Property_Data_for_Engineering_Materials.pdf.
Jianhua Wu, Functional Textiles for Improved Performance, Protection and Health (Book), 2011, Chapter 10, pp. 226-245, Woodhead Publishing Series in Textiles, United States.
Womens Neoprene Suit Collection | Roxy. Available https://www.roxy.com/women-neoprene-suits/.
How to shop the perfect winter neoprene swim or surf suit—Grazia. Available at https://graziamagazine.com/articles/how-to-shop-and care for-neoprene-...8.
Chloroprene—Kirk-Othmer Encyclopedia of Chemical Technology. Copyright John Wiley & Sons, Inc. USA.
Polyamides, Plastics—Kirk-Othmer Encyclopedia of Chemical Technology. Copyright John Wiley & Sons, Inc. USA.
Body Glove Women's Neo What? Retro Zip One Piece Swimsuit Advertisement, annotated. Currently unavailable from the webstore of Swimoutlet.com. Similar style here: https://www.swimoutlet.com/products/body-glove-swimwear-80s-throwback-time-after-time-one-piece-swimsuit-8152876.

* cited by examiner

SWIMSUIT WITH LEFT-HANDED OPENING MECHANISM

CROSS REFERENCE TO PENDING APPLICATIONS

This application claims the benefit of U.S. Provisional Patent Application No. 62/369,733; Filed Aug. 1, 2016; and entitled SWIMWEAR GARMENT WITH CIRCUMFERENTIAL OPENING, the entire contents of which are incorporated by reference herein.

BACKGROUND

Field of the Invention

This invention relates generally to form fitting garments made from stretchable fabric and more particularly to garments used as swimwear. More particularly, this invention relates to women's swimwear where the design must be fashionable, the suit form fitting and supportive, and durable to sustain activity. The concepts described can be applied to swimwear garments worn for accessible and therapeutic applications where the wearer is limited in his or her range of motion.

Description of Related Art

Women's swimsuits are available in a wide range of applications. Traditional fashion examples are one-piece garments with separated shoulder straps, scooping neck and back lines that cover the wearer's abdomen, and extend past the hip region. A two-piece bikini design has evolved with varied tops and bottoms. Certain bikini designs have eliminated over-the-shoulder straps and modified the bottom piece to include many different short shapes. Competitive designs have come to include a full covering of the wearer's body and are often constructed of layers of fabric—certain layers to reduce drag and other layers to entrain air and promote floatation.

Some of the newest versions of women's swimwear have been loose fitting, full body coverings for adherence to religious laws, one to two-piece conversions, wrapping designs that include additional body coverings, and specific maternity designs to promote swimming as an activity for pregnant women while avoiding the use of a two-piece with an external cover-up garment. A wearer of a swimsuit may encounter difficulties with dressing and undressing while wearing swimsuits in use today. In addition, removing a swimsuit may be difficult if seated, or by pulling a swimsuit down to the ground when standing on outdoor surfaces such as sand.

Swimwear, specifically women's swimwear, is constructed from fabric designed to adhere to the wearer's skin to provide support and allow for one size to fit a wider range of body shapes and sizes. The moduli of these fabrics vary such that some may stretch easily, such as Lycra, while others will stretch only slightly, such as polyesters. Unfortunately, even a fabric designed to stretch may not when it is adhered to the wearer's skin by the surface tension of entrained or saturated water. Removing such suits requires cumbersome peeling, rolling, and pulling to remove the suit.

BRIEF SUMMARY OF THE INVENTION

The present invention generally pertains to women's swimwear and particularly to women's swimwear with an opening mechanism feature to facilitate removal using a minimum range of body motion and reduced force in comparison to the force required by swimsuits of equivalent size and covering. This is in part due to the opening mechanism serving as a tension relieving means. Additionally, the present invention facilitates removal without sacrificing durability or comfort.

The novelty of the present invention is centered on, but not limited to, its use of an opening mechanism on the front, torso-covering portion of the suit. The opening mechanism extends from a point on the suit near the chest region of the wearer to a point on a leg cuff. While one leg cuff remains a fixed, closed circle, the second leg cuff is broken by the opening mechanism and opens with the suit when the opening mechanism is unfastened and the suit is in its open configuration. Fastening the opening mechanism to close the suit, and situate the second leg cuff as a closed circle, secures the suit in such a manner that the wearer can participate in a wide range of activities without fear of the suit opening.

Dressing and disrobing steps with the novel suit are simplified due to the reduction of fixed, closed circular leg cuffs from two to one. A wearer can step into the closed leg cuff and pull the novel suit to cover her body while only encountering the elastic resistance of one leg cuff. This reduces the amount of time required for bending, pulling, and covering.

Disrobing with the novel suit is also simplified due to the opening mechanism on the torso-covering portion of the suit. Detaching the opening mechanism to remove the suit relieves tension resultant from stretchable fabrics used in swimsuit construction, and also acts as a single step to relieve elastic tension and remove entrained air and water.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Figure 1:
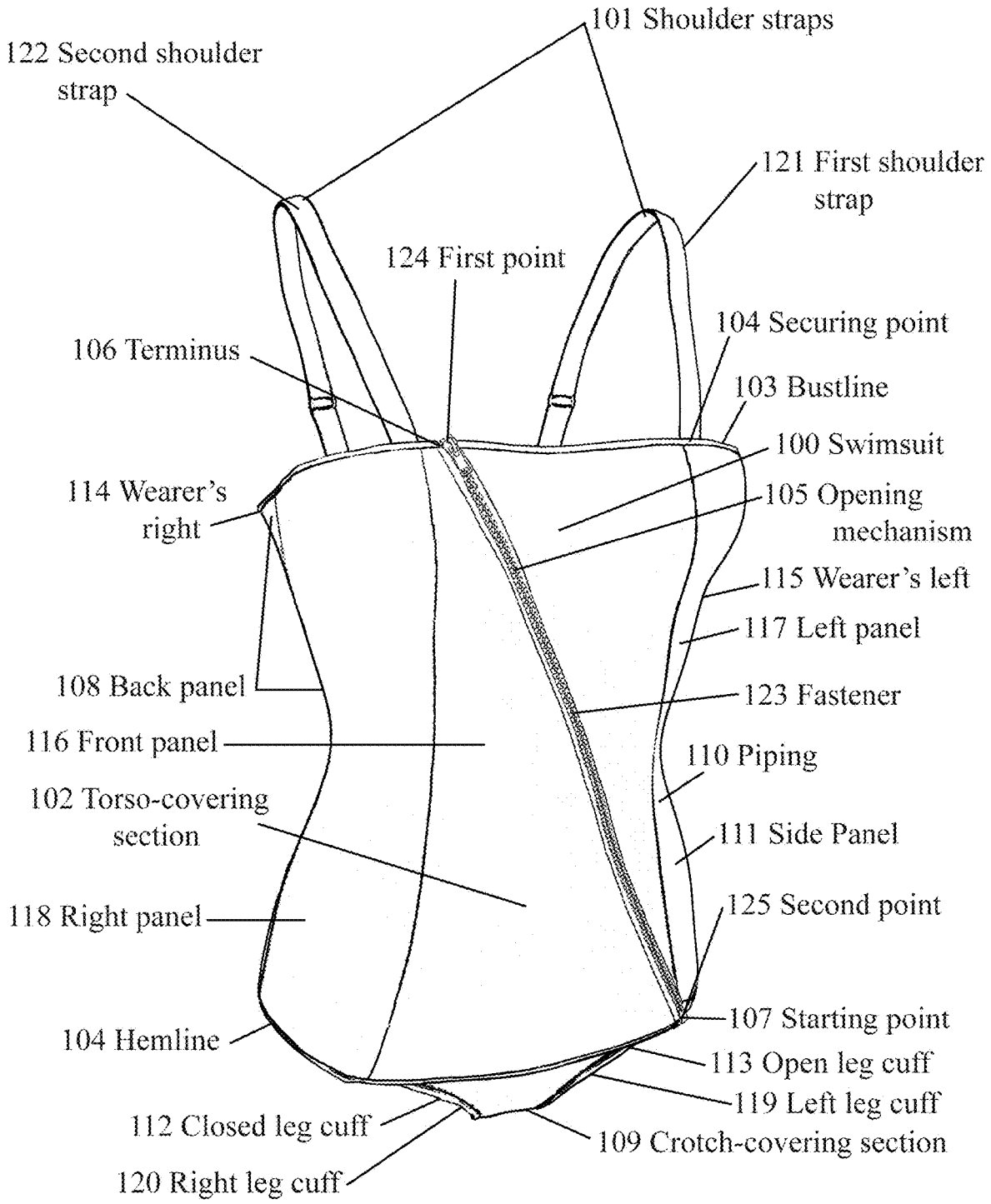
FIG. 1 is a perspective view of the front of an exemplary embodiment swimsuit in a closed configuration.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

The present invention provides an advantage over existing swimsuit offerings by reducing the effort, time, and force required to put on and remove the garment. The novel location and orientation of an opening mechanism also functions as a tension relieving means. This enhanced functionality reduces the adhesion of the fabric to the skin of the wearer, regardless of the elasticity, while also allowing the wearer to remove the suit with one hand. Often, the only way to remove swimsuits currently on the market is to peel them off and roll the entire fabric of the suit down the wearer's body. For example, an alternative one-piece swimsuit of the prior art may include ties in multiple locations to facilitate easy removal, but these ties may become unsecured while carrying children or swimming in moving tides and surfs, resulting in an embarrassing predicament for the wearer.

The present invention is quickly removed in one piece with minimal body movement and can be accomplished as a one-hand operation. The opening mechanism is comprised of a fastener that is a zipper according to preferred embodiments. The fastener extends at an angle from one side of the chest region to the bottom hemline on the opposite hip and modifying a closed circular leg cuff to an opening in the process. In contrast, much of the prior art is comprised of suits employing a zipper, the zipper toggle is centered on the neckline or bustline, and the suit opens to the waist. The advantages of one-handed removal are many. For example, persons with limited mobility are now able to hold the suit in one hand, and a stabilizer bar with the other. Once removed, the suit can be held in one hand and never placed on the ground.

According to certain embodiments employing a zipper, the zipper toggle is placed at the bustline, off-center, and the suit opens from the chest to the hemline. After the zipper is opened, the suit still remains on the wearer by the shoulder straps and the closed leg cuff, but the tension of the elastic fabric is eliminated and the surface tension of absorbed and entrained water is broken.

The zipper is situated at a diagonal along the front surface of the garment. When the suit is opened at the fastener, the front panel, or torso-covering section, separates, creating an opening in a circumferential direction around the wearer's waist while still secured by the closed leg cuff. This allows for a much smaller section of fabric to be slid to the wearer's feet prior to removing the garment.

Once the tension is relieved, the smaller fabric sections require a lower force to yield from their surface tension cling to wet skin, as well as elastic force on dry skin. In addition, because only one leg cuff is closed, the friction and elasticity encountered during removal is only encountered on one of the wearer's legs, or reduced by 50%.

The angle creates a path separating the elastic fibers, thus reducing the pull force to put on and remove the suit. The angle of the fastener also reduces the force to stretch the elastic fibers because the angled zipper creates a constant, yet shortened length of fiber separation. Traditional one-piece swimsuits have a constant length, requiring an increasing separation force as the swimsuit is pulled further and further from the wearer and towards the ground.

The addition of an angled zipper presents benefits beyond tension relief. For example, because a zipper can be opened with one hand while the suit hangs from the wearer's shoulders, only one had is required to disrobe. This permits the wearer to use the other hand to grip a bar for fall prevention. Alternatively, a one-handed removal process resolves an unmet need for amputees and stroke victims seeking a swimsuit that provides complete torso coverage but not two hands to peel it down the wearer's body. Once the zipper is opened with one hand, the same hand may be used to remove the shoulder straps, and then the wearer can step out of the suit. This elimination of bending presents an added benefit for people with limited rotational mobility due to back injuries or disc degeneration. With the present invention, the suit is brought to and from the wearer instead of the suit being brought to and from the floor. The use of a double-pull zipper eliminates any preference for left or right-handed persons.

It is critical to distinguish the angled fastener from present offerings employing a longitudinal fastener. In contrast to the angled fastener of the present invention, a longitudinal fastener still requires two hands to put on and take off the suit, does not relieve the elastic tension of the fabric in the up and down directions required for swimsuit removal, and does not open the suit around the hips or legs of the wearer. A zip-up-the-center design of the prior art still requires a step in and out, a bend over to grab the garment, a twist to put the arms on, and a reach for the zipper. The bend and twist motions would be very difficult for someone with herniated lumbar discs. The angled fastener of the present invention creates the indispensable result of opening the swimsuit around the wearer.

The angled fastener of the present invention also preserves a solid cloth section of the swimsuit crotch area. The front zippers on commercially available suits, often stop at the wearer's waist to maintain a solid crotch covering. These front-zippered options are also distinguishable from the present invention. The preferred embodiments are able to have a solid crotch section with the diagonal orientation of the zipper. This prevents a wearer from having to sit on a fastener. Currently available accessible swimsuits rely on fasteners to separate the suit at the crotch-covering region. This may expose the wearer in an embarrassing manner should the closure mechanism of the multi-piece crotch-covering region fail. In addition, the location of a closure mechanism at a sensitive personal region may cause discomfort to the wearer.

Unfortunately, there is little effort focused on swimsuits for the mother, grandmother, and accessible wearers. Physical limitations may include reduced flexibility, injuries from childbirth, incontinence, and a reduced range of motion. Instead of being offered fashionable solutions, members of the aforementioned groups are relegated to options that may be strong on modesty, but light on fashion. Swimsuit requirements of these women include full coverage for comfort and modesty, durability to withstand carrying children and participating in family recreation, and most importantly, the need for easy and quick removal due to physical limitations and the need to care for companions. These differ greatly from the needs of competitive swimmers and triathletes where present swimsuit innovations are directed.

In contrast to prior art "convertible" swimwear with a separating fastener to create a two-piece suit, the angled fastener instead creates openings in the forward and circumferential directions for the wearer to remove the suit. The present invention remains a one-piece garment due to its connected back-covering and crotch, or bottom-covering, sections.

Current swimsuit offerings that do create circumferential openings have inherent limitations that the present invention has resolved. For example, SlipOn Swimsuits include a circumferential opening, but require two-handed operation to pull the blousy fabric sections up and over the wearer's shoulders. The first step in putting on a SlipOn Swimsuit is sitting down. This is not always an option in places such as beaches, and does not address those with physical limitations and reduced ranges of motion. Additionally, while a SlipOn Swimsuit may be a viable option as an accessible garment, the loose fabric wrap of the garment across the wearer's torso will not withstand the grasp of a young child being carried by the wearer, resulting in an embarrassing moment.

For the purposes of this description, the term torso-covering section is interchangeable with the fashion term front panel. Specifically, a front panel is a portion of fabric that covers the front of the wearer's body, the front being the same side as the wearer's face. Back panels cover the wearer's back. Side panels are fabric portions that cover a wearer's external oblique muscles. The side panels may be decorative, constructed of different fabrics than the front or back panels, and may be left open as is consistent with various swimsuit fashion trends. In some embodiments, the torso-covering section is connected to a back-covering section via a pair of side panels. The torso-covering section, side panels, and back-covering section may be a continuous piece of fabric or combinations of separate pieces of fabric.

The term hemline has been used in a way to be inclusive of the leg cuffs, for the application to swimwear, from traditional dressmaking. The term bustline is used in its traditionally accepted meaning, and also refers to the entire top edge of the swimsuit as it completely covers and wraps the wearer. A leg cuff that is "closed" is a complete circle. An "open" leg cuff is one where its circle has been broken by the separation of an opening mechanism. "Circle" may mean an elliptical or curved oblong shape resulting from V-tapers towards a wearer's hips from a wearer's crotch.

As it is used in the claims, side refers to the left or right side of the wearer consistent with the left and right designations of a wearer's hands. The boundary for the sides is a bisecting plane breaking a person's nostrils and perpendicular to a person's shoulders. The term diagonal is used to refer to the resulting path of the opening mechanism from a point on the wearer's bustline to a point on the wearer's hemline on the opposite-hand side. The term vertical is used to describe the path of the opening mechanism when its starting point and terminus are located on the same side, as in a point on the bustline of the left-side of the wearer and a point on the hemline above the left leg. The diagonal direction of the opening mechanism is an angle from the horizon that is between 10 degrees and 80 degrees and is the result of the placement of the opening mechanism's starting points and terminus on the bustline or hemline, respectively and interchangeably.

The term "starting point" used in the claims to describe the opening mechanism's location is to be defined as the point where the joining of fasteners would traditionally begin, specifically, for exemplary embodiments using a zipper, the starting point would be where the zipper insertion pin is joined to the zipper slider head/toggle and retainer box, so as to join together the first few teeth. The Merriam-Webster Dictionary defines "terminus" as a finishing point. The terminus for the present invention would be consistent with the zipper's top stop. For these exemplary embodiments where the zipper is the opening mechanism, initiating closure would be the joining of the insertion pin to the zipper slider head/toggle and retainer box. For exemplary embodiments using buttons or hook and loop fasteners, the starting point would be the fastening of the first of their series at one end of their line. The novelty of the present disclosure remains when the starting point and terminus are interchanged or exchanged.

The designation of the opening mechanism's starting point and terminus are used specifically for description purposes. The novelty of the present disclosure exists when the starting point and terminus are interchanged. Preferred embodiments will use a starting point on the hemline and a terminus on the bustline. This specifically relates to the preferred and exemplary embodiments using a zipper as the opening mechanism. This locates a single-pull zipper toggle near the wearer's eyes, with the desire to prevent an inadvertent or unrealized opening of the swimwear garment.

Inventions described by the present disclosure and exemplary embodiments are constructed of fabric materials known in the art of swimsuit fabrication such as polyester, Lycra™, Spandex™, Nylon™, and combinations therein.

Detailed Description of the Design

A garment having a shoulder securing means that is connected to a torso-covering section extending from a bustline to a hemline. The torso-covering section has a terminus for an opening mechanism extending from a point on the bustline in a diagonal direction to a starting point for the opening mechanism on the hemline. The starting point on the hemline is situated on an opposite side of the terminus on the bustline and the torso-covering section is connected to a back-covering section. In other embodiments, the opening mechanism starting point is on a leg cuff and the opening mechanism terminus is on the bustline.

Other embodiments will locate the opening mechanism starting point on the bustline and the opening mechanism terminus is on a leg cuff. Specifically, certain embodiments will situate the opening mechanism terminus on the left-side of a garment-wearer's bustline and the opening mechanism starting point on the right leg cuff. Alternatively, the opening mechanism terminus may be located on the right-side of a garment-wearer's bustline and the opening mechanism starting point will be on the left leg cuff.

The opening mechanism of the present invention will be a fastener selected from the group consisting of, but not limited to: zippers, double-pull zippers, hook and loop fasteners, Velcro™, self-engaging mushroom fasteners, semi-circle buckles and straps, locking plastic clips, buttons, snaps, or combinations therein.

Certain embodiments may include an ornate frill that serves as a decorative element and a functional element to cover the opening mechanism.

Shoulder securing means for exemplary embodiments may be straps, neck cuffs with exposed shoulders, or may be a T-shirt connected to the torso-covering section at the bustline. Specifically, the shoulder securing means for certain embodiments will be a pair of straps extending from the torso-covering section over a wearer's shoulders to the back-covering section. The present invention may employ shoulder securing means that are a single strap extending from the torso-covering section over a wearer's shoulders, on either a wearer's left-side or right-side, to the back-covering section and a sleeve with a shoulder covering section on the wearer's side opposite to the single strap.

Additional embodiments are described having a shoulder securing means connected to a torso-covering section. The torso-covering section extends from a bustline to a hemline. The torso-covering section has a starting point for an opening mechanism on the hemline, extending in a vertical direction to a terminus on the bustline. Further, the torso-covering section is connected to a back-covering section. Specifically, exemplary embodiments may have an opening mechanism starting point on the bustline and the terminus on the hemline. Alternatively, the starting point for the opening mechanism may be on the leg cuff and the terminus on the bustline. In one embodiment, the opening mechanism extends in a vertical line from the left leg cuff to a point on the bustline on the left-side of a garment wearer. Its mirror image, described as the opening mechanism extending in a vertical line from the right leg cuff to a point on the bustline on the right-side of a garment wearer, is also a novel invention and exemplary embodiment.

The vertical fastener configuration enhancement to the novel invention may include an ornate frill to conceal the opening mechanism. The opening mechanism may be fasteners from the group previously described. The opening mechanism in the vertical configuration also serves as a tension-relieving means.

The shoulder securing means may be: a pair of straps extending from the torso-covering section over a wearer's shoulders to the back-covering section, a T-shirt joined to the bustline, or a single strap extending from the torso-covering section over a wearer's shoulders, on either a wearer's left-side or right-side, to the back-covering section and a sleeve with a shoulder covering section on the wearer's side opposite to the strap. The shoulder securing means may also be neck cuff with open shoulder cups and sleeves. This configuration secures the suit at the neckline with a neck cuff, connects to the bustline with sleeves, but also exposes the wearer's shoulders as is desired per certain fashion trends.

Detailed Description of the Use

A method for dressing with a swimsuit with two leg cuffs, a shoulder securing means, and an opening mechanism situated across a front surface of the swimsuit, the opening mechanism extends along a line from a point on the chest area to a point on a leg cuff that is opposite to the leg cuff containing an opening mechanism point, is a closed circle, is described by the following steps. Firstly, the opening mechanism is in the open position and a wearer steps a foot into the leg cuff not separated by the opening mechanism. The wearer pulls the garment to place the shoulder securing means in contact with the wearer's shoulders. Next, the wearer connects the opening mechanism at one of its ends. Lastly, the wearer closes the opening mechanism.

DETAILED DESCRIPTION OF THE DRAWINGS

A perspective view of the front of an exemplary embodiment swimsuit in a closed configuration is presented in FIG. 1. The swimsuit garment 100 is classified as a one-piece swimsuit with adjustable shoulder straps 101, a torso-covering section 102, side panels 111 that connect the torso-covering section 102 to the concealed back-covering section 108. In the exemplary embodiment shown, decorative piping 110 is situated on the boundaries of the torso-covering section 102 and the side panels 111. An opening mechanism 105 has a starting point 107 on the hemline 104 of the left, open leg cuff 113. The terminus 106 of the opening mechanism 105 is on the bustline 103. The shoulder straps 101 are also secured at points 116 on the bustline 103 and back-covering section 108 (concealed). The opening mechanism 105 of this exemplary embodiment is a zipper.

The closed leg cuff 112 is opposite to the open leg cuff 113 location of the opening mechanism 105 starting point 107. In the exemplary embodiment shown, the staring point 107 is on the wearer's left-side 115 and the opening mechanism terminus 106 is on the wearer's right-side 114. The crotch covering section 109 is solid and is connected to the torso-covering section 102 and the back-covering section 108 (concealed) at the hemline 104.

Figure 2:
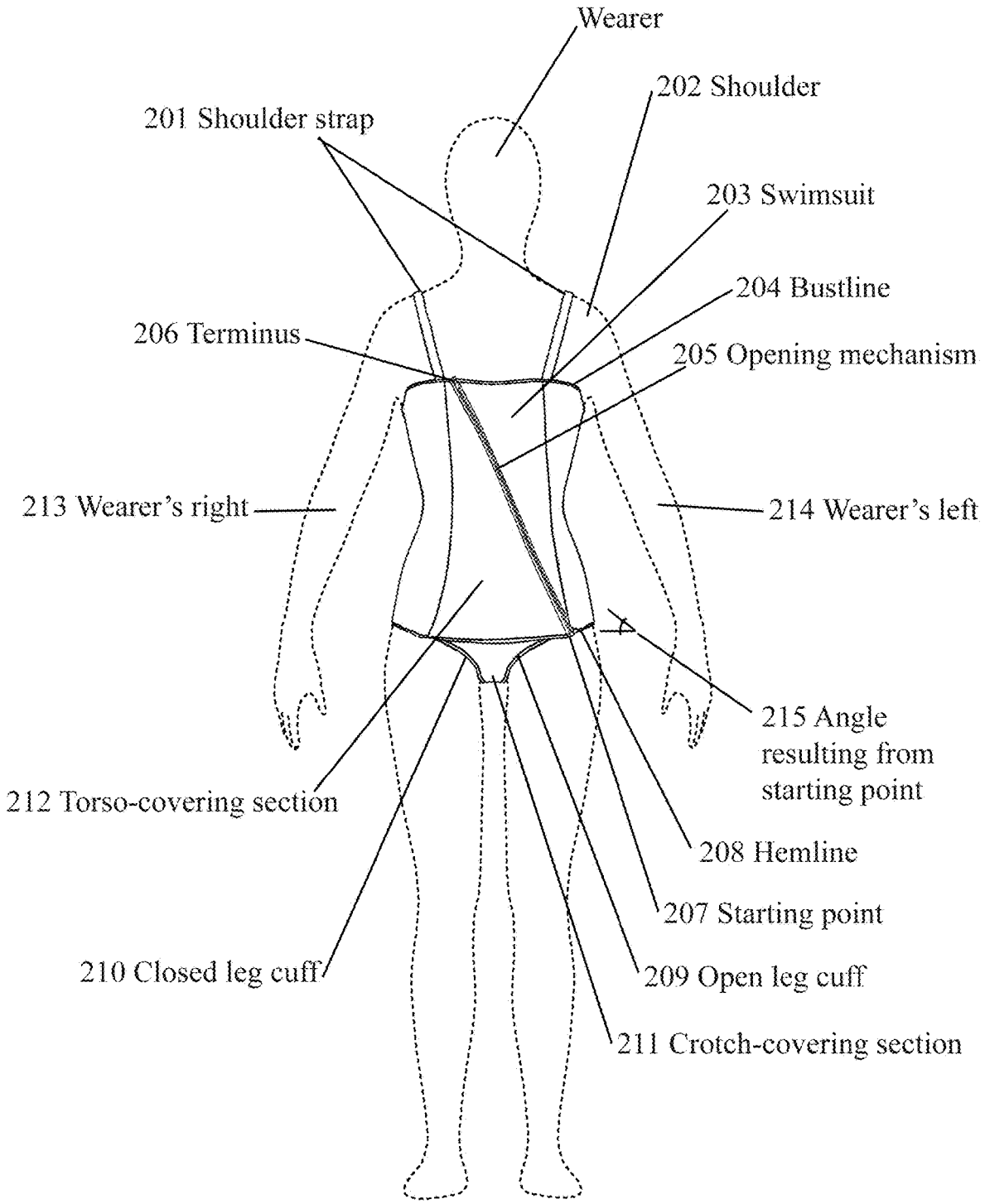
FIG. 2 is a front view of a wearer dressed in an exemplary embodiment swimsuit in the closed configuration, the opening mechanism extending from a point on the right side of the wearer's bustline to a point on the left side of the wearer's hemline.

FIG. 2 presents a front view of a wearer 200 dressed in an exemplary embodiment swimsuit 203 in the closed configuration, the opening mechanism 205 extending from a terminus point 206 on the right side of the wearer's bustline to a starting point 207 on the left side of the wearer's 200 hemline 208. The shoulder securing means are straps 201. The straps 201 extend over the wearer's 200 shoulders 202 and are connected to the torso-covering section 212 and the back-covering section, not shown. The terminus 206 breaks the bustline 204. The angle 215 of the opening mechanism 205 diagonal across the torso-covering section 212 is resultant from the location of the starting point 207 on the hemline 208 and the terminus 206 on the bustline 204. The open leg cuff 209, referred to as open because it can change from a closed circle to a broken circle by the unfastening of the opening mechanism 205, is on the wearer's 200 left-side 214. The closed leg cuff 210 on the wearer's 200 right-side 213, referred to as closed because it will always be a circle due to the absence of an opening mechanism 205 on its hemline 208. Even though the unfastening of the opening mechanism 205 may break the hemline 208 of the open leg cuff 209, the crotch-covering section 211 is a solid piece of fabric.

Figure 3:
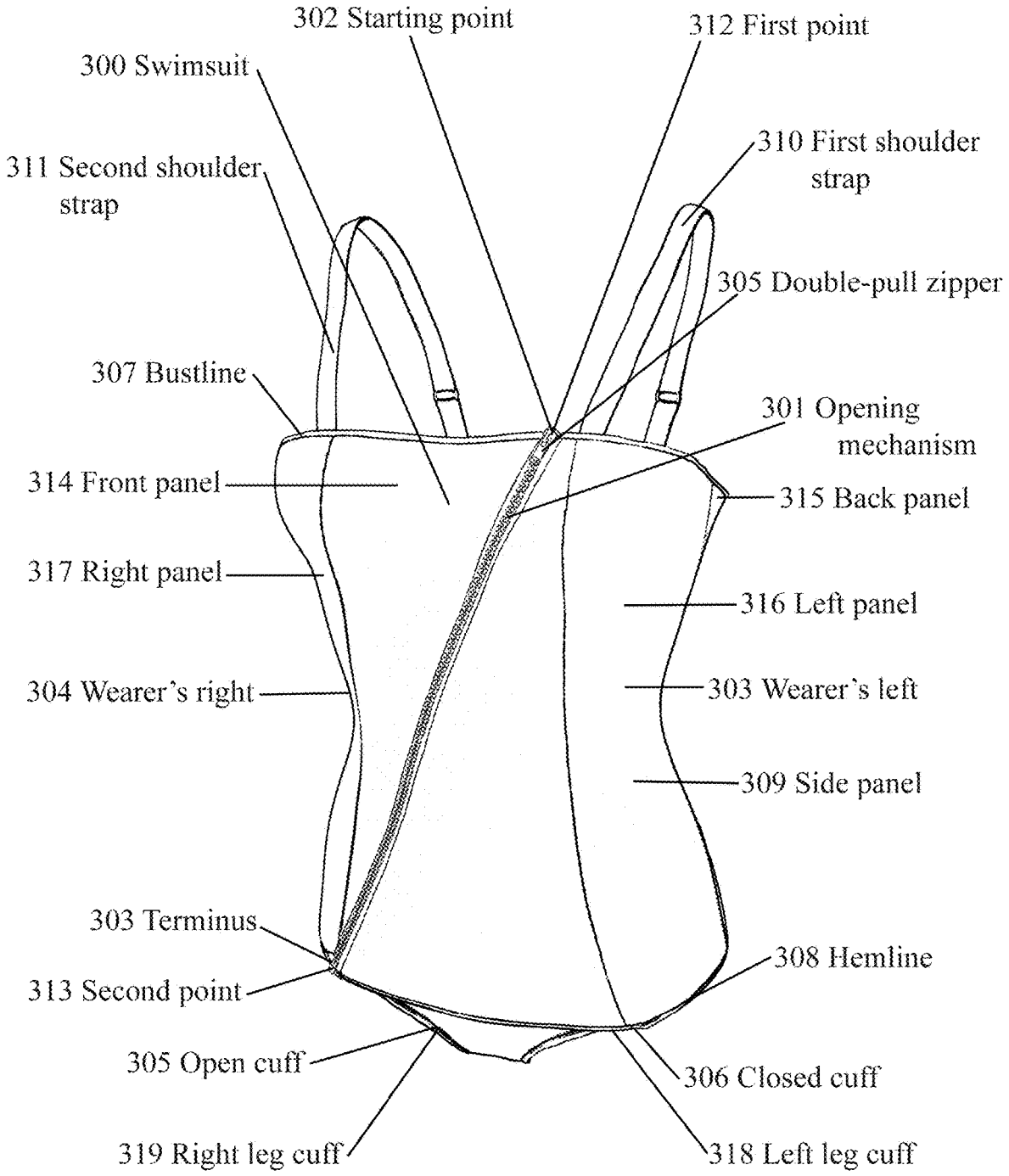
FIG. 3 is a front view of an exemplary embodiment swimsuit where the opening mechanism is a double-pull zipper, extending from a point on the left side of the wearer's bustline to a point on the right side of the wearer's hemline.

FIG. 3 is a front view of an exemplary embodiment swimsuit 300 where the opening mechanism 301 is a double-pull zipper 305. In a mirror-image configuration of the exemplary embodiments shown as FIGURE's 1 and 2, the opening mechanism 301 extends from a starting point 302 on the left side 303 of the wearer's bustline 307 to a terminus point 303 on the right side 304 of the wearer's hemline 308. The closed leg cuff 306 is on the wearer's left-side 303 and the open leg cuff 305 is located on the wearer's right-side 304. The side panels 309 shown are solid fabric, but in other embodiments may have portions removed, be constructed of alternative fabrics such as mesh or metallic, so as to serve as decorative elements. Decorative elements as side panels 309 allows for the present invention, designed to promote accessibility and modesty, to maintain conformance with fashion trends and not appear as designated for people desiring accessibility or possessing reduced ranges of physical motion. The swimsuit 300 in FIG. 3 is structured as a torso-covering section extending from a bustline 307 to a hemline 308, the torso-covering section defining a front panel 314, a back panel 315, a left panel 316, and a right panel 317, wherein the panels are connected to form a continuous piece of the swimsuit 300 adapted to wrap around a body of a wearer. The hemline 308 defining a crotch-covering section, a left leg cuff 318, and a right leg cuff 319, and a first shoulder strap 310 extending from the front panel 314 to the back panel 315 of the bustline, the first shoulder strap 310 located on the left panel 316 of the torso-covering section, wherein the first shoulder strap 310 is connected to the front panel 314 and the back panel 315 on a left side of the torso-covering section; a second shoulder strap 311 extending from the front panel 314 to the back panel 315 of the bustline 307, the second shoulder strap 311 located on the right panel 317 of the torso-covering section, wherein the second shoulder strap 311 is connected to the front panel 314 and the back panel 315 on a right side of the torso-covering section. An opening mechanism 301 that is a fastener directly located on the front panel 314 of the torso-covering section, the fastener extending from a first point 312 located directly on a left side of the bustline 307 of the front panel 314 to a second point 313 located directly on the right leg cuff 319 of the hemline, wherein the first point 312 is located directly adjacent to the first shoulder strap 310. Wherein the fastener opening mechanism 301 extends diagonally from the first point 312 to the second point 313 only in one direction, which is from the left side of the bustline 307 to the right leg cuff 319 of the hemline 308.

Figure 4:
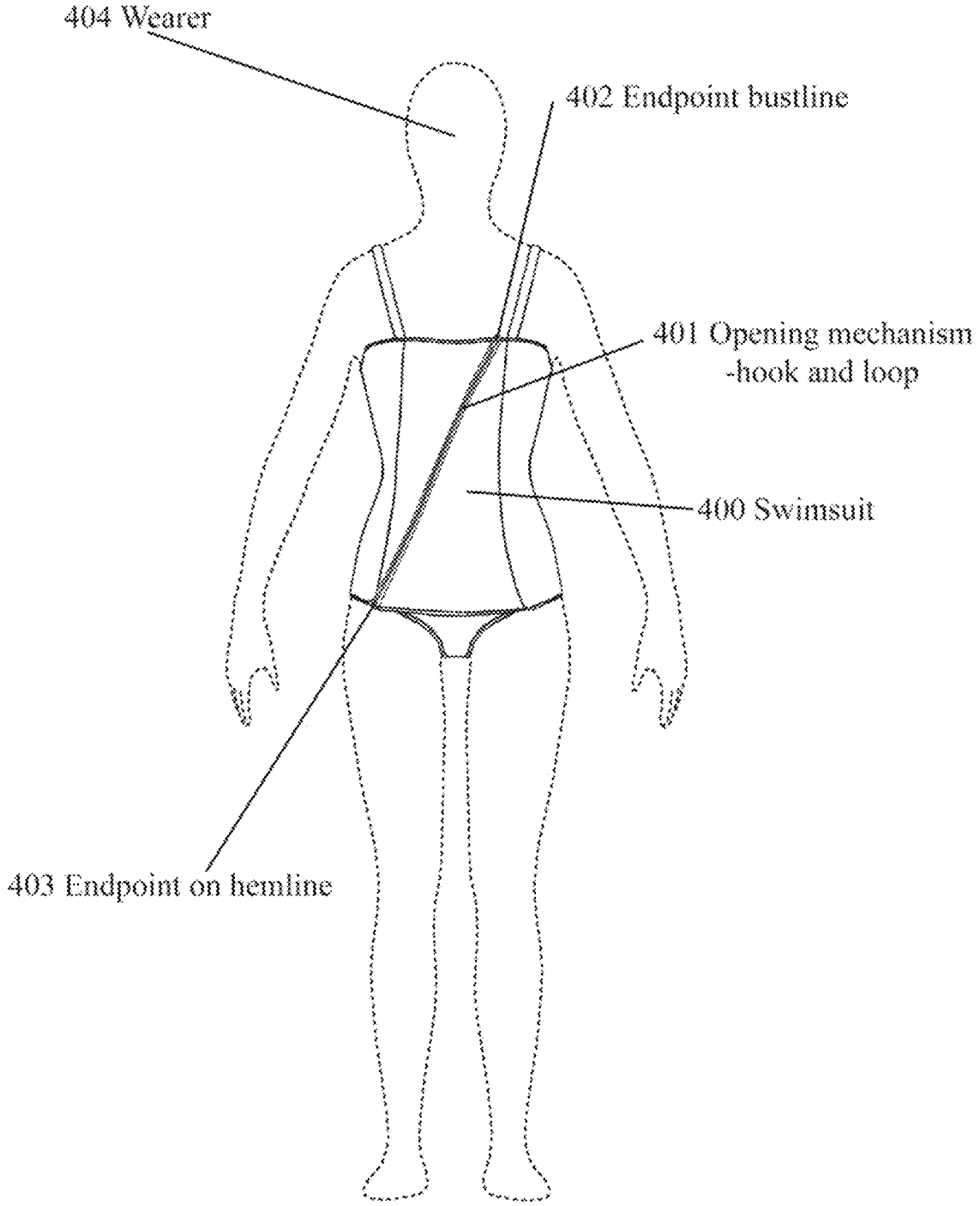
FIG. 4 is a front view of a wearer dressed in an exemplary embodiment swimsuit in the closed configuration, where the opening mechanism is a hook and loop fastener.

FIG. 4 is a front view of exemplary embodiment swimsuit 400 in the closed configuration, where the opening mechanism 401 is a hook and loop fastener. An advantage of a hook and loop fastener for the wearer 404 is the declassification of the opening mechanism's 401 endpoints 402, 403 on the bustline and hemline, respectively, as starting or terminus points.

Figure 5:
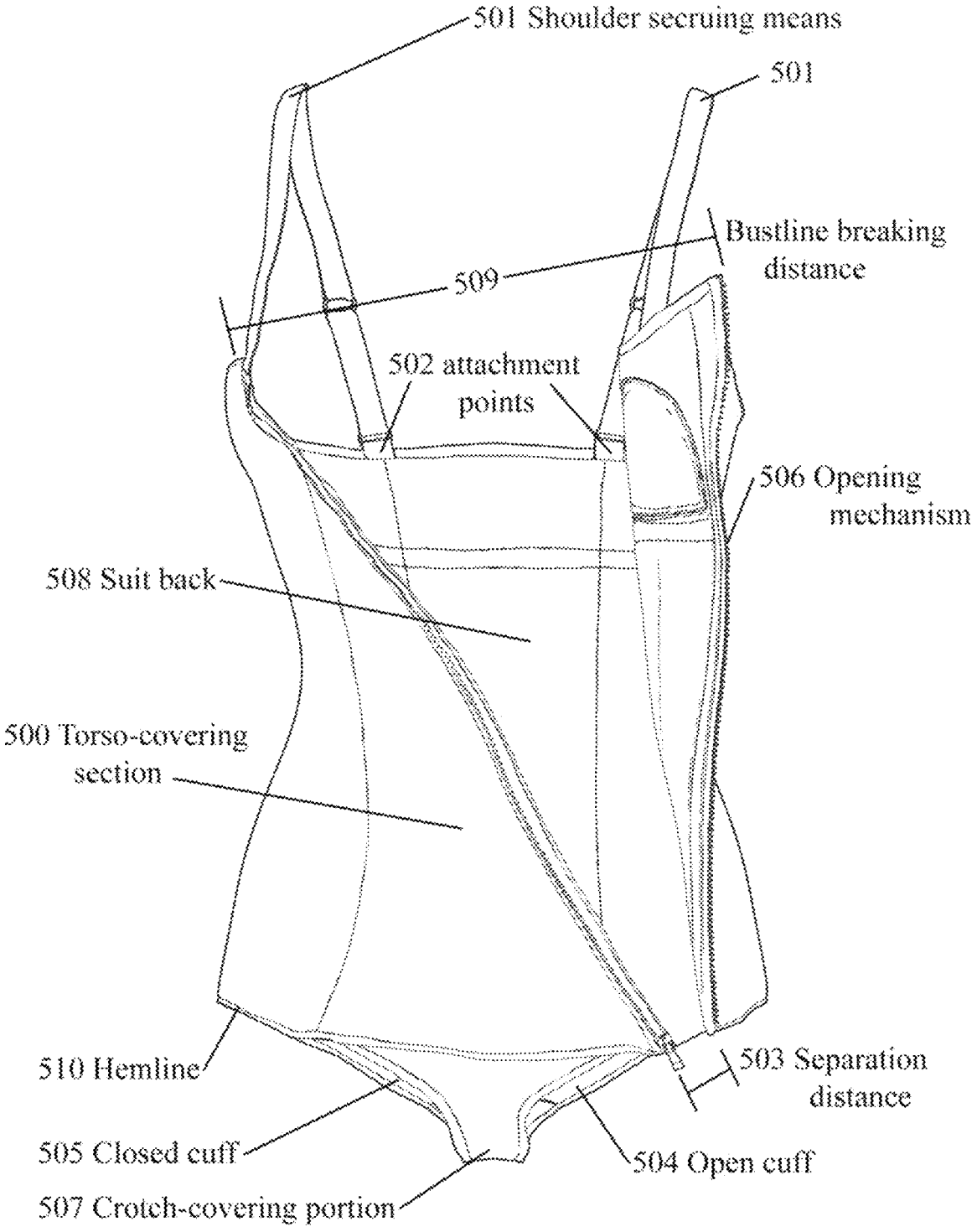
FIG. 5 is a front perspective view of an exemplary embodiment swimsuit in the open configuration.

An example embodiment in the open configuration, presented as a perspective view is shown as FIG. 5. The suit front, or torso-covering section 500 has been split in a diagonal line by the unfastening of the opening mechanism 506. The open configuration in the perspective view shows the attachment points 502 of the shoulder securing means, here straps 501, to the suit back 508. A separation distance 503 at the open cuff 504 breaks the hemline 510. This figure shows the suit back 508 of an open suit. The bustline is breaking distance 509 of the open suit is shown. The open cuff 503 is on the wearer's left-side and a solid crotch-covering portion 507 divides it from the closed cuff 505.

Figure 6:
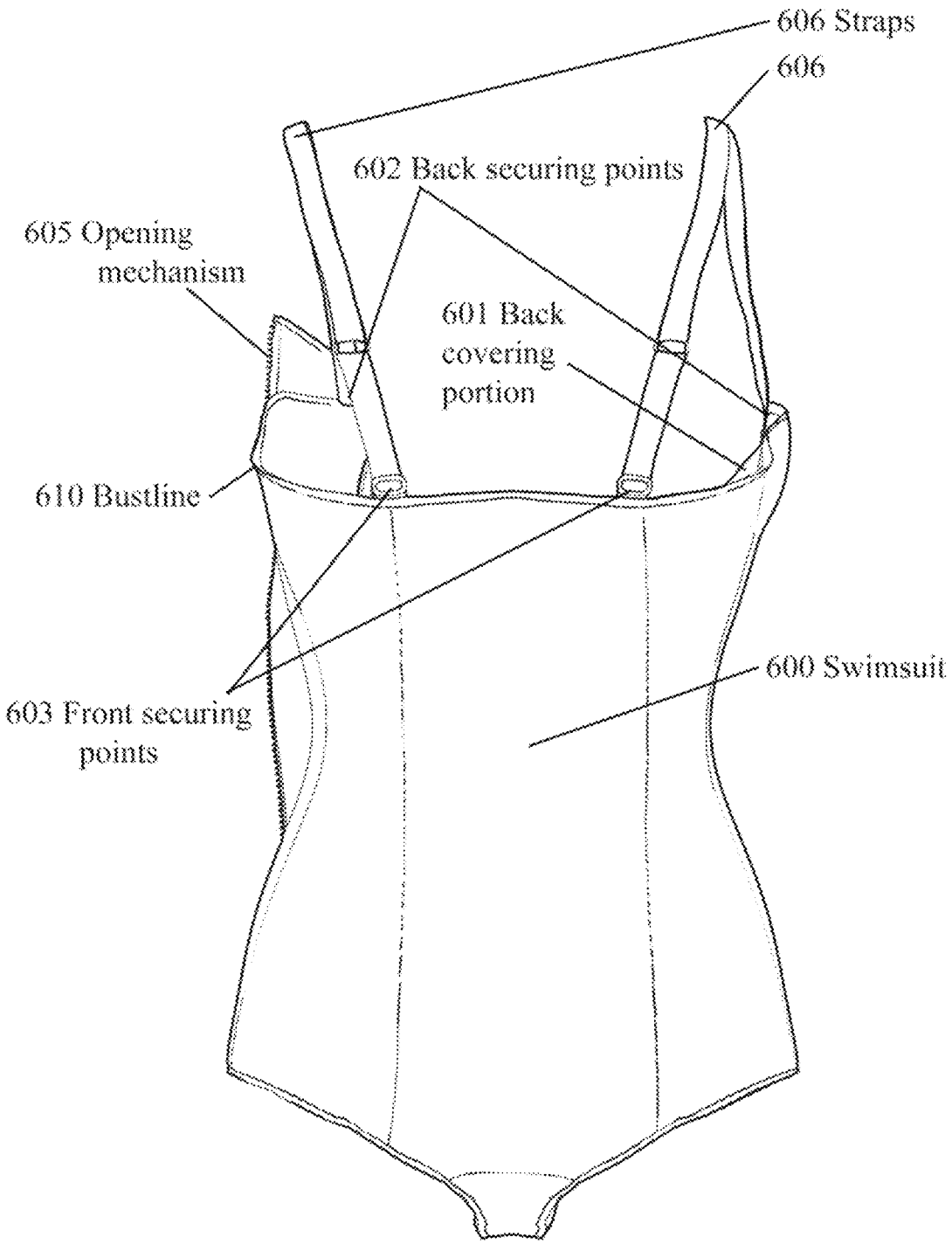
FIG. 6 is a back view of an exemplary embodiment swimsuit in the open configuration.

FIG. 6 is a back view of an exemplary embodiment swimsuit shown in FIG. 5 in the open configuration. The back-covering portion 601 of the swimsuit 600 is solid fabric as shown, but could be constructed of different fabrics or have openings as current fashion trends dictate. The points for securing the shoulder straps 606 on the back 602 and front 603 securing points are fixed at the straps 606 on the suit's 600 bustline 610.

Figure 7:
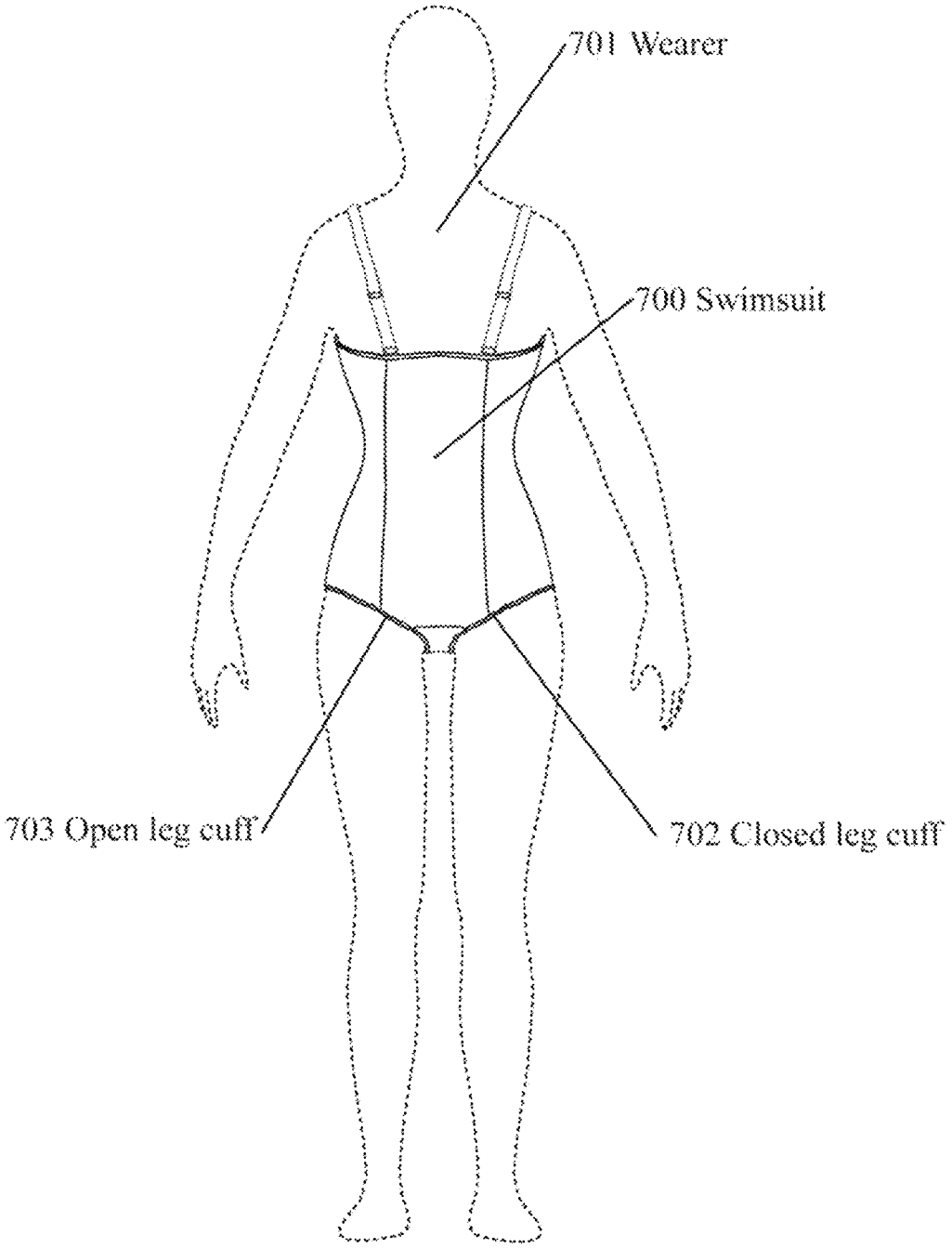
FIG. 7 is a back view of a wearer dressed in an exemplary embodiment swimsuit in the closed configuration.

FIG. 7 is a back view of a wearer 701 dressed in the exemplary embodiment swimsuit 700 of FIGS. 5 and 6, in the closed configuration. Note that from the back, in the closed configuration, the leg cuffs 702, 703 are indistinguishable as closed or open cuffs, respectively.

Figure 8:
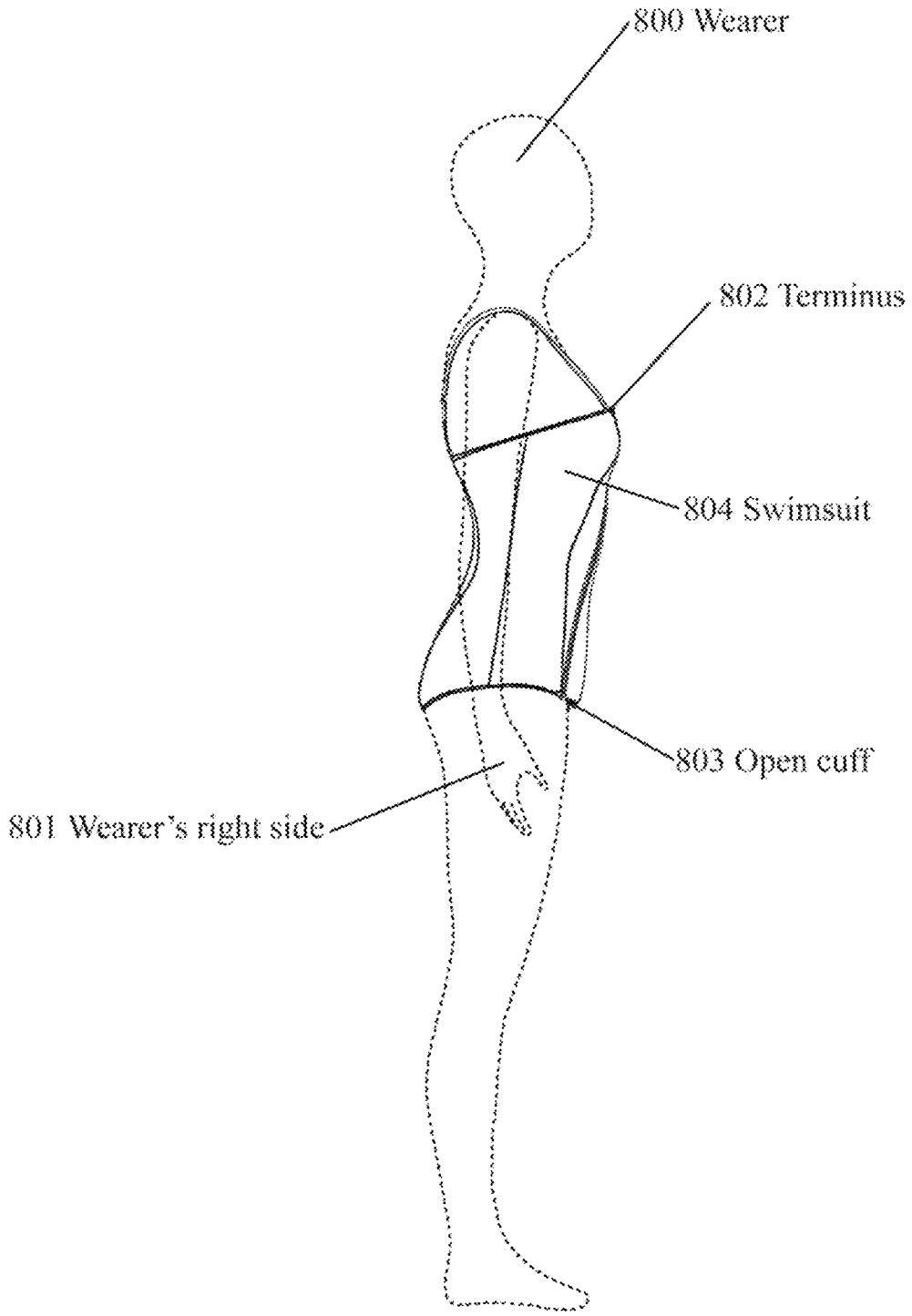
FIG. 8 a right side view of a wearer dressed in an exemplary embodiment swimsuit in the closed configuration.

FIG. 8 is a right side view of a wearer 800 dressed in an exemplary embodiment swimsuit 804 in the closed configuration. The terminus 802 of the opening mechanism is on the bustline of the wearer's 800 left-side. The open cuff 803 is shown in this view of this suit 804 as facing the wearer's right-side 801.

Figure 9:
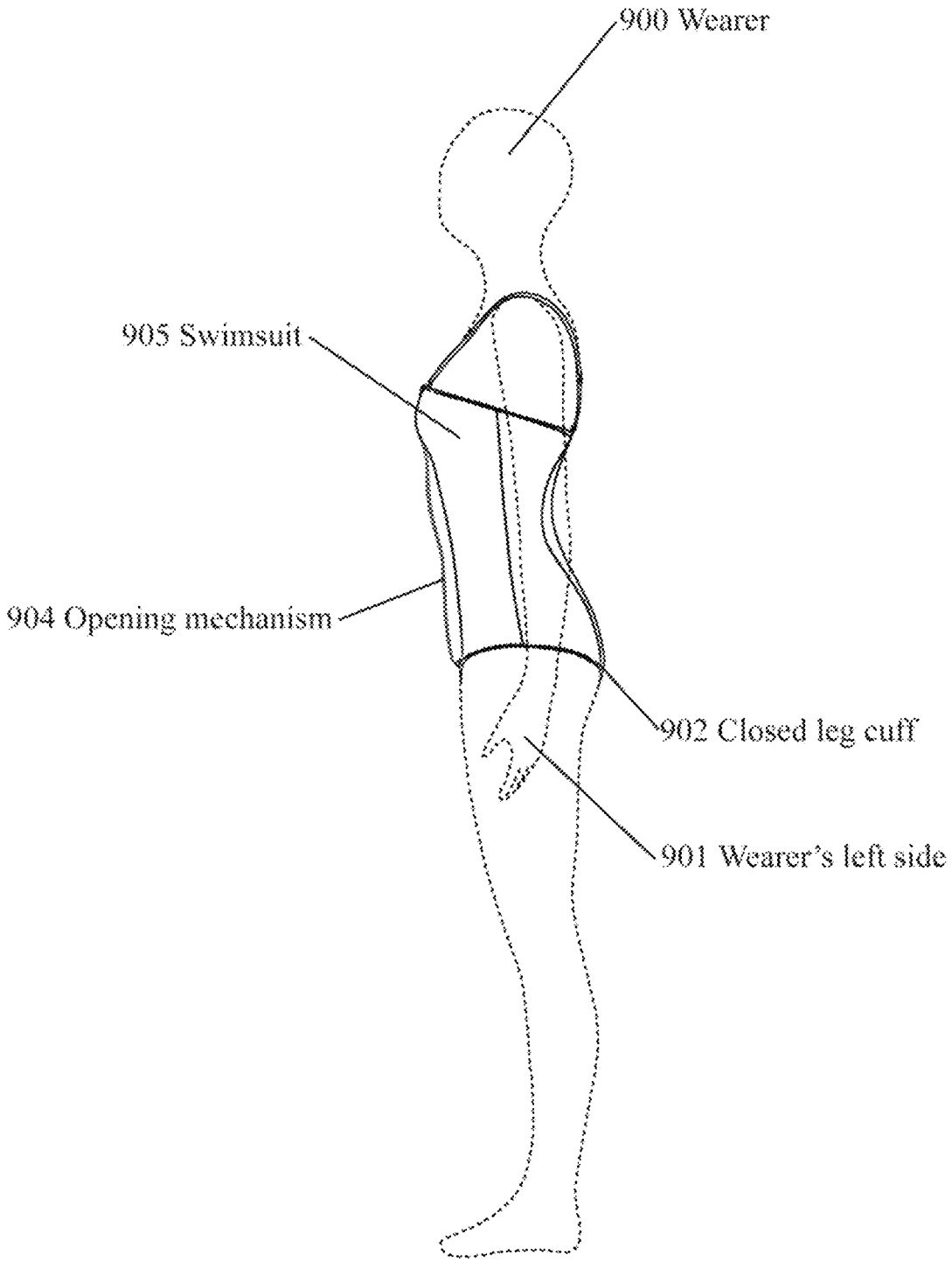
FIG. 9 a left side view of a wearer dressed in an exemplary embodiment swimsuit in the closed configuration.

FIG. 9 a left side view of a wearer 900 dressed in the exemplary embodiment swimsuit 905 shown in FIG. 8. The suit 905 is in the closed configuration. The closed leg cuff 902 and the opening mechanism 904 are shown on the wearer's left-side 901. The opening mechanism 904 is situated in a diagonal line from the wearer's left-side 901 to the wearer's right-side, concealed in this view.

Figure 10:
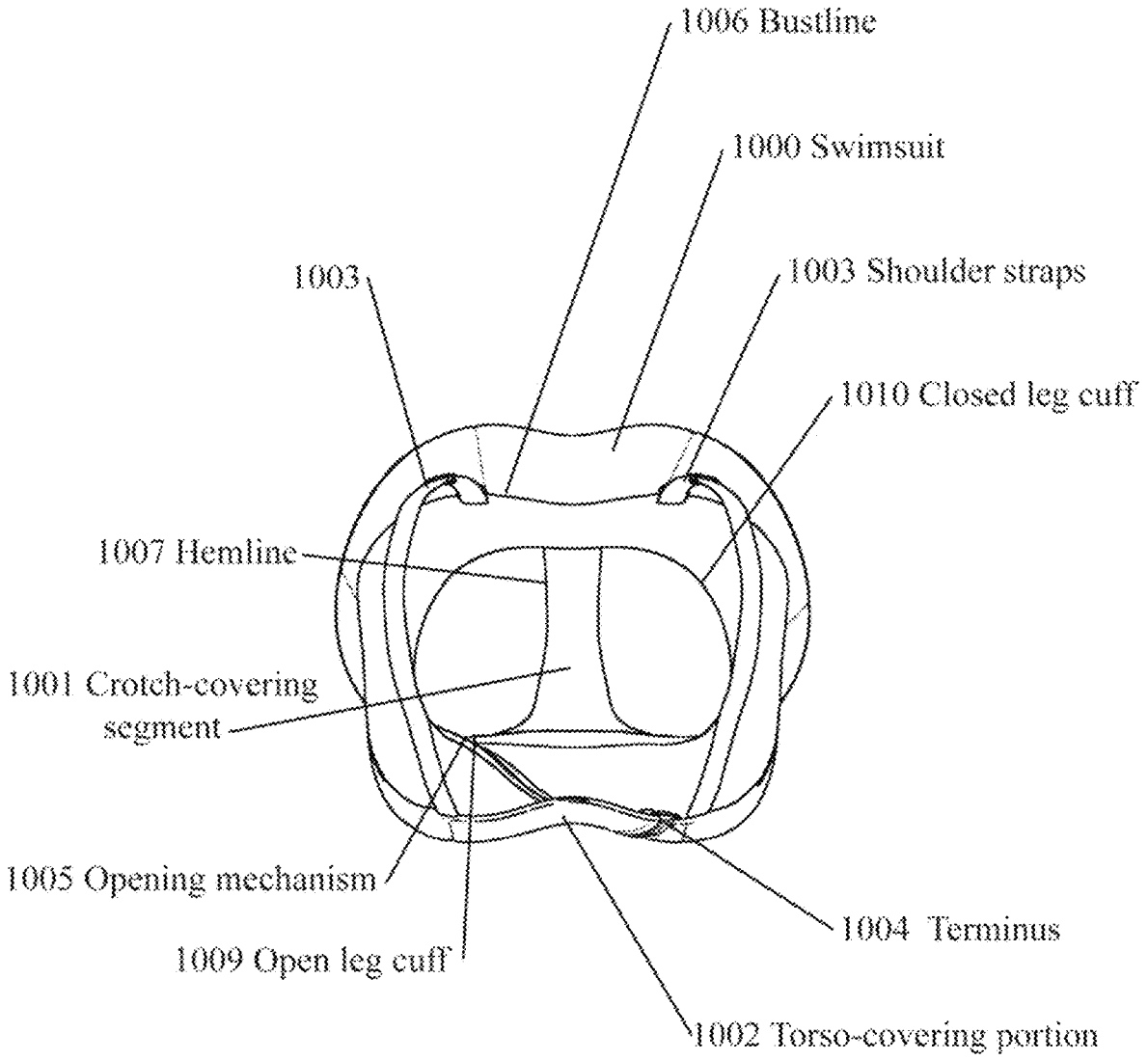
FIG. 10 is a top view of an exemplary embodiment swimsuit in the closed configuration.

The top view of an exemplary embodiment swimsuit 1000 in the closed configuration is included as FIG. 10. The top view displays the physical relation between the hemline 1007, the unbroken crotch-covering segment 1001, and the open 1009 and closed 1010 leg cuffs. The terminus 1004 of the opening mechanism 1005 breaks the bustline 1006 of the torso-covering portion 1002.

Figure 11:
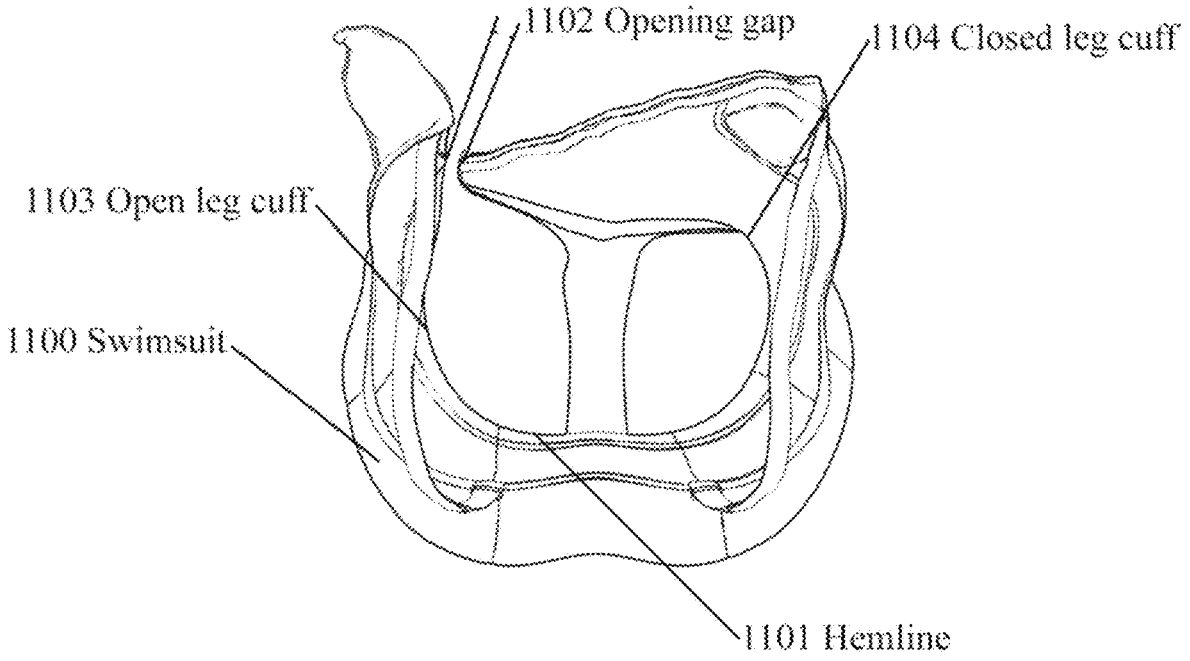
FIG. 11 is a top view of an exemplary embodiment swimsuit in the open configuration.

FIG. 11 is a top view of an exemplary embodiment swimsuit 1100 that is a mirror image of the suit shown in FIG. 10, in the open configuration. The hemline 1101 is broken at the open leg cuff 1103 at a distance shown as the opening gap 1102. The hemline 1101 is unbroken around the closed leg cuff 1104.

Figure 12:
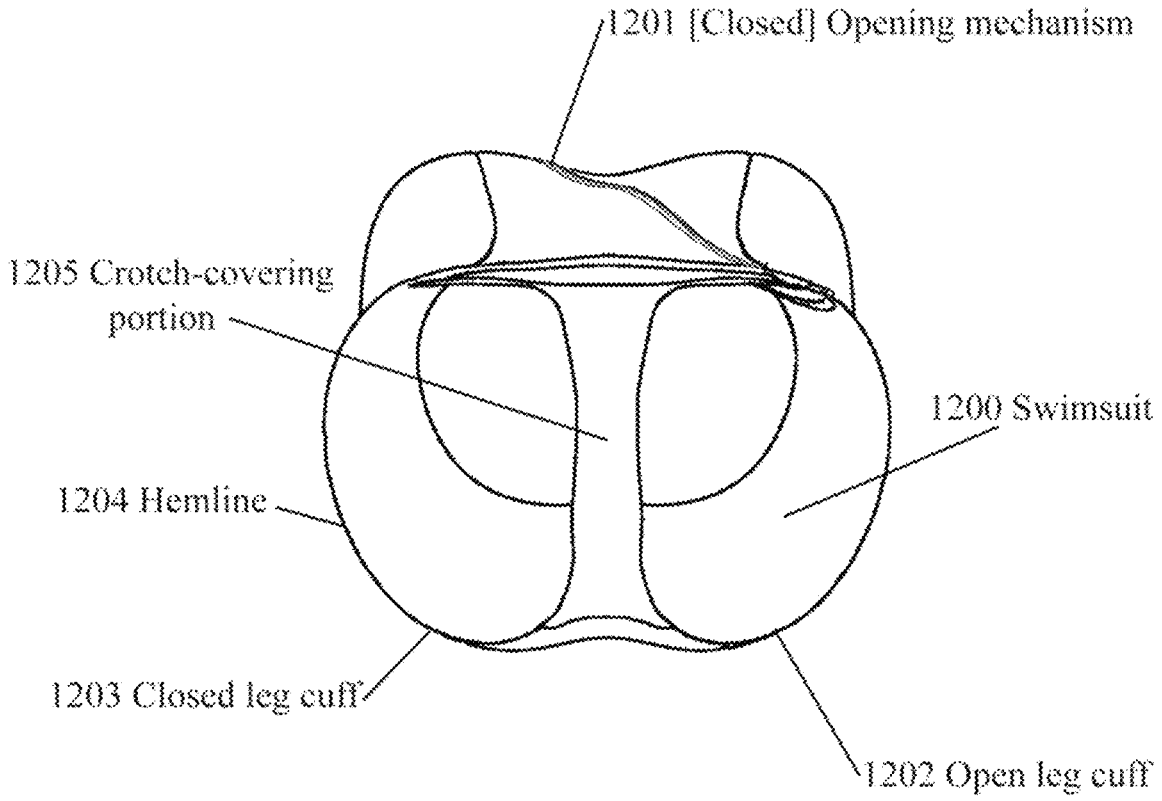
FIG. 12 is a bottom view of an exemplary embodiment swimsuit in the closed configuration.

FIG. 12 is a bottom view of an exemplary embodiment swimsuit 1200 in the closed configuration. Because the opening mechanism 1201 is fastened, or closed, both leg cuffs 1202, 1203, are unbroken circles. This figure displays the modified definition of the hemline 1204, specific to this application, meaning all the lines at the bottom of the swimsuit 1200. This definition is consistent with the use of the term hemline as applied to dress slacks, where each leg cuff has its own hemline, but here, the closed crotch 1205 forms boundaries for the hemline 1204 of the leg cuffs 1202, 1203.

Figure 13:
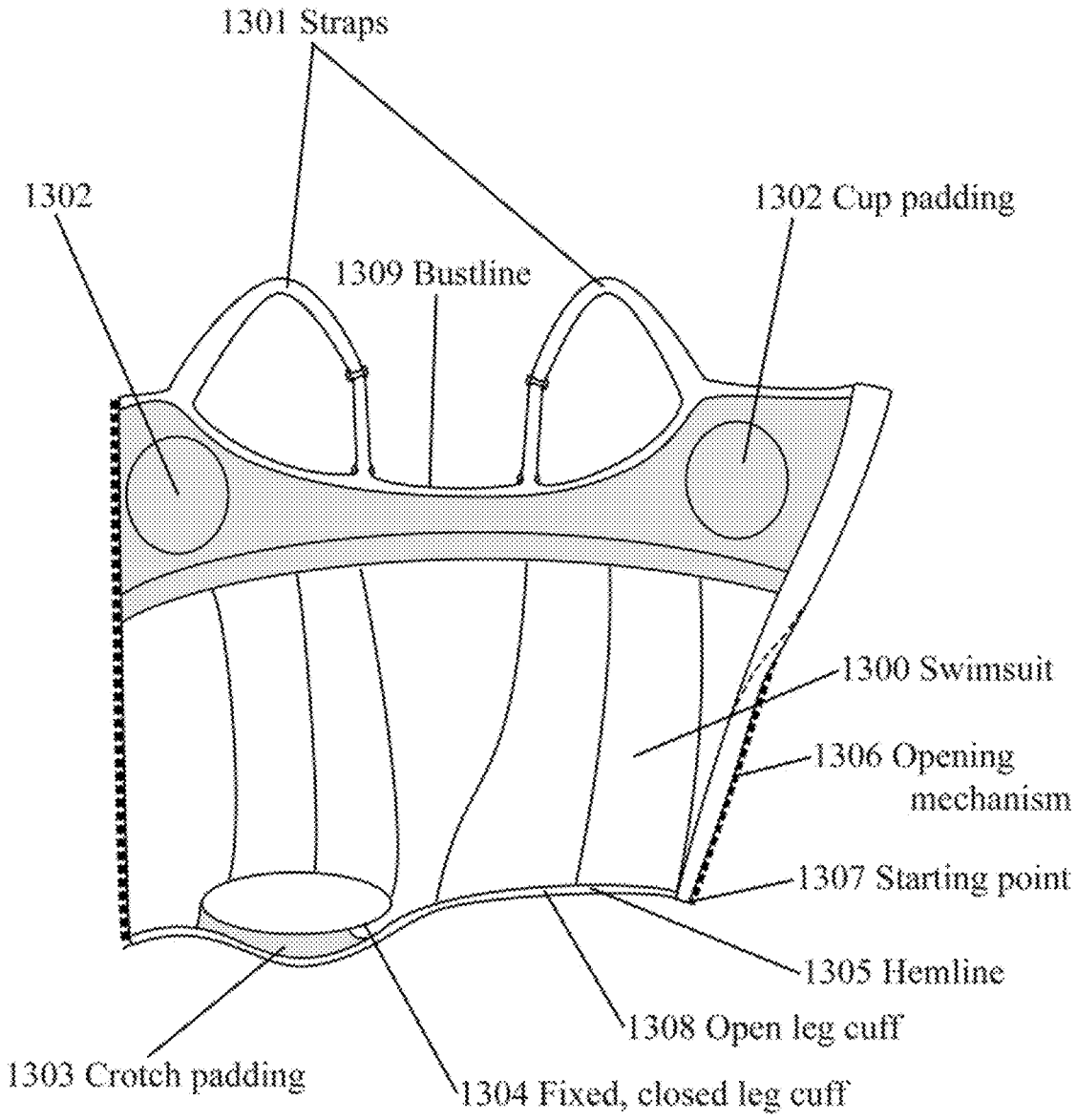
FIG. 13 is a front view of an exemplary embodiment swimsuit in the open configuration; the swimsuit is laid flat.

FIG. 13 is a front view of an exemplary embodiment swimsuit 1300 in the open configuration; the swimsuit 1300 is laid flat. The hemline 1305 is defined by the boundaries labeled about the fixed, closed leg cuff 1304 and the open leg cuff 1308, broken by the starting point 1307 for the opening mechanism 1306. The bustline 1309 is continuous in the open position, with attachment points for the straps 1301. This rendering displays the crotch 1303 and cup 1302 padding common to female swim garments.

Figure 14:
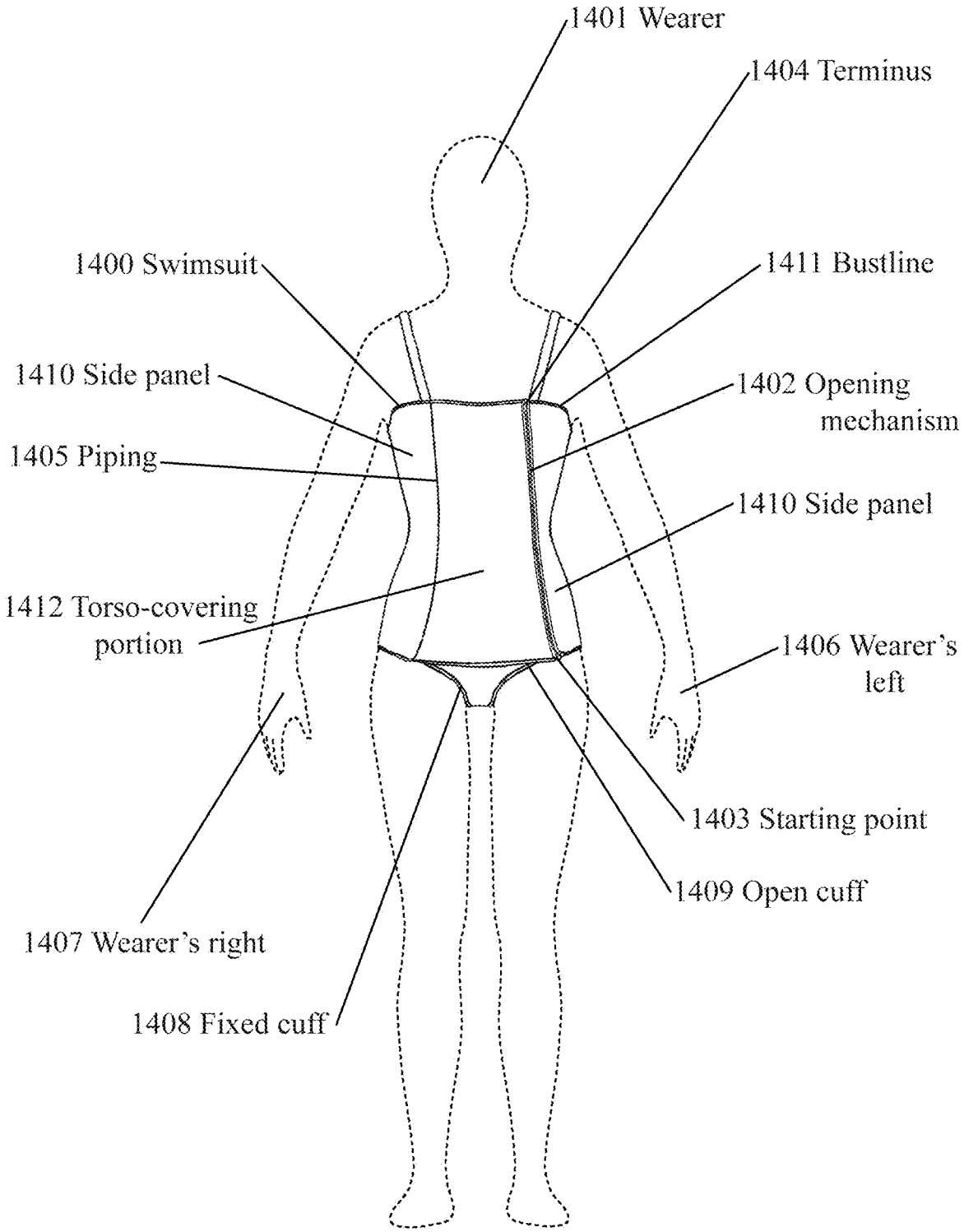
FIG. 14 is a front view of a wearer dressed in an exemplary embodiment swimsuit with an opening mechanism, the opening mechanism extends vertically from a point on the wearer's bustline to a point on the wearer's hemline and both points are on the same side of the wearer.

In some embodiments, the opening mechanism 1402 will be in a vertical orientation as shown in the front view of FIG. 14. The opening mechanism 1402 extends vertically from a point on the wearer's 1401 bustline 1411 to a point on the wearer's hemline 1412 and both points are on the same side of the wearer 1401, here the left-side 1406. In the example shown, the opening mechanism 1402 is in a vertical line from a starting point 1403 to its terminus 1404. The opening mechanism 1402 is the boundary between the side panel 1410 and the torso-covering section 1412. Unlike embodiments shown in previous FIGURES, the open cuff 1409 is on the same side of the wearer 1401 as the terminus 1404, situated on the bustline 1411.

Opposite to the opening mechanism 1402 on the wearer's 1401 right-side 1407, decorative piping makes the boundary between the side panel 1410 and the torso-covering portion 1412. The fixed cuff 1408 is on the opposite side of the open cuff 1409, as defined by its integration with the opening mechanism 1402 starting point 1403. The opening mechanism may be situated on the mirror-image location in other embodiments.

Figure 15:
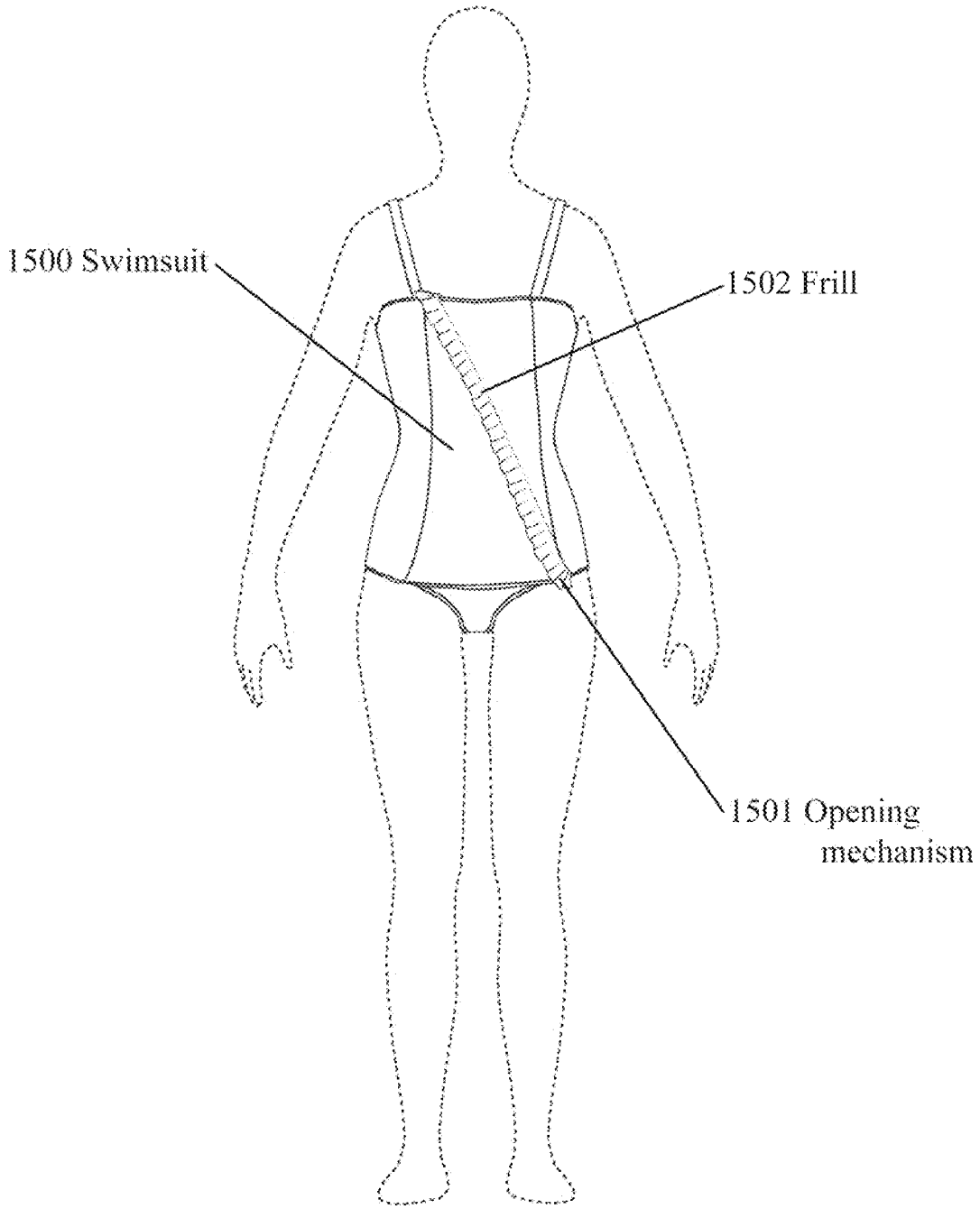
FIG. 15 is a front view of a wearer dressed in an exemplary embodiment swimsuit with an added frill to conceal the opening mechanism extending across the torso-covering section of the swimsuit.

FIG. 15 is a front view of a wearer dressed in an exemplary embodiment swimsuit 1500 with an added frill 1502 to conceal the opening mechanism 1501 extending across the torso-covering section of the swimsuit.

Figure 16:
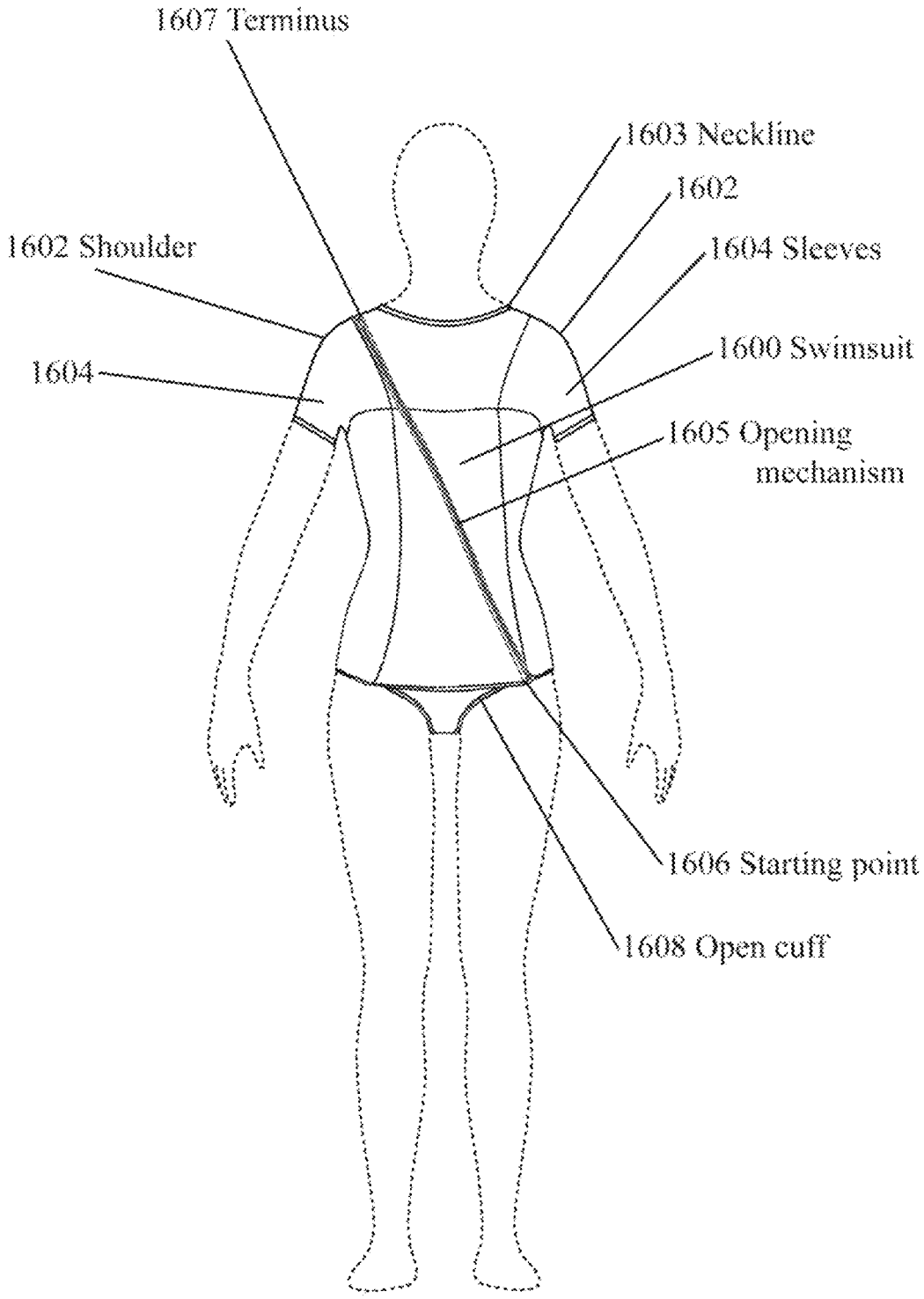
FIG. 16 is a front view of a wearer dressed in an exemplary embodiment swimsuit where the shoulder securing means is constructed of swimsuit fabric in a T-shirt shape.

In certain embodiments, the shoulder securing means may be selected as a T-shirt, as shown in FIG. 16. This front view of a wearer dressed in an exemplary embodiment swimsuit 1600 where the shoulder securing means is constructed of swimsuit fabric in a T-shirt shape, complete with neckline 1603 and sleeves 1604. The terminus 1607 of the opening mechanism 1605 is now situated on the wearer's shoulder 1602. The location of the opening mechanism 1605 starting point 1606 on the open leg cuff 1608 is unchanged from previously described embodiments.

Figure 17:
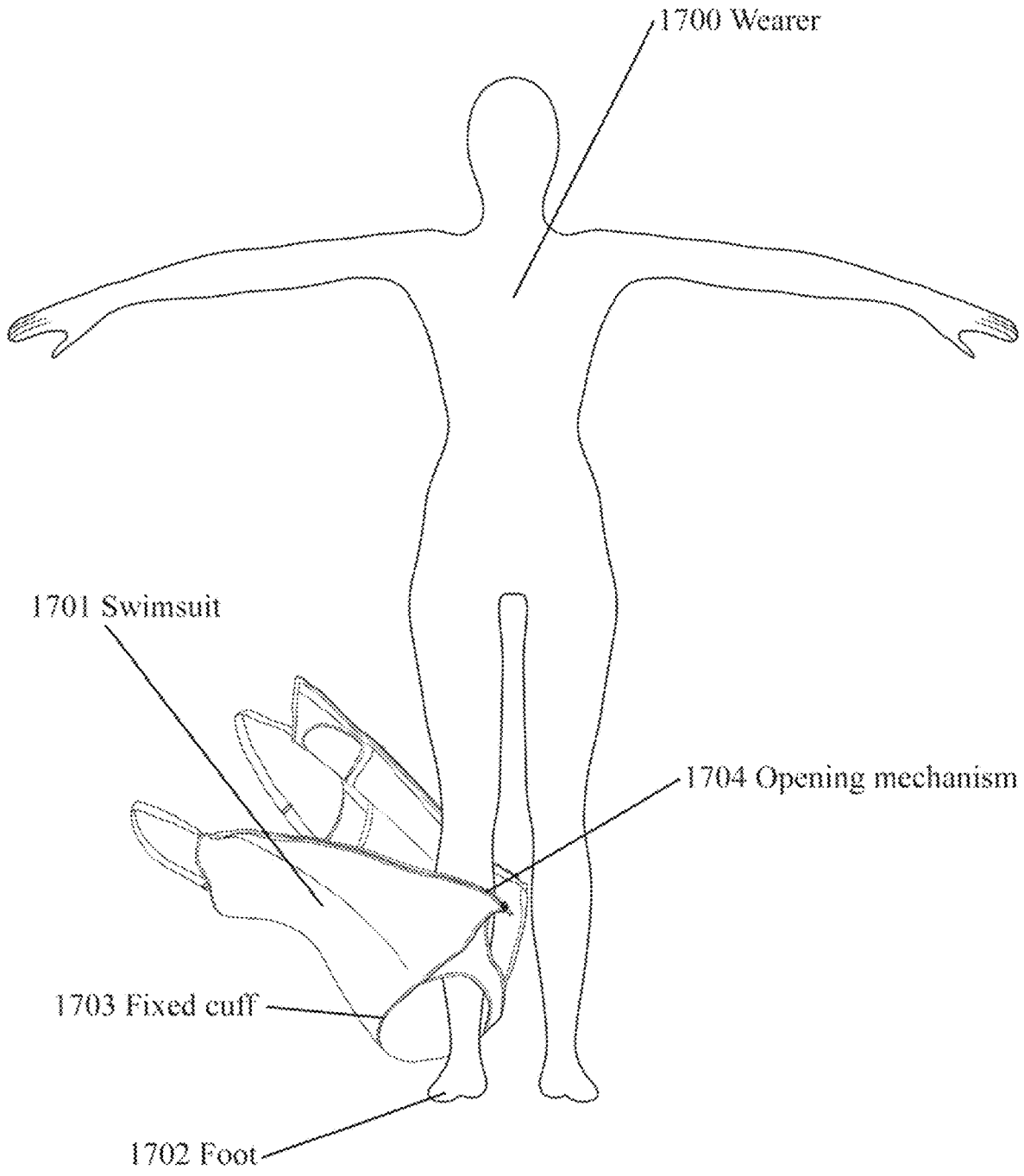
FIG. 17 is the front view of the first step for a wearer dressing in an exemplary embodiment swimsuit.

The first step for a wearer dressing in an exemplary embodiment swimsuit is shown as FIG. 17. The first step in dressing is shown as the front view of a wearer 1700 and an exemplary swimsuit 1701 in the open configuration, as its opening mechanism 1704 is unfastened. The wearer 1700 places her foot 1702 in the fixed leg cuff 1703.

Figure 18:
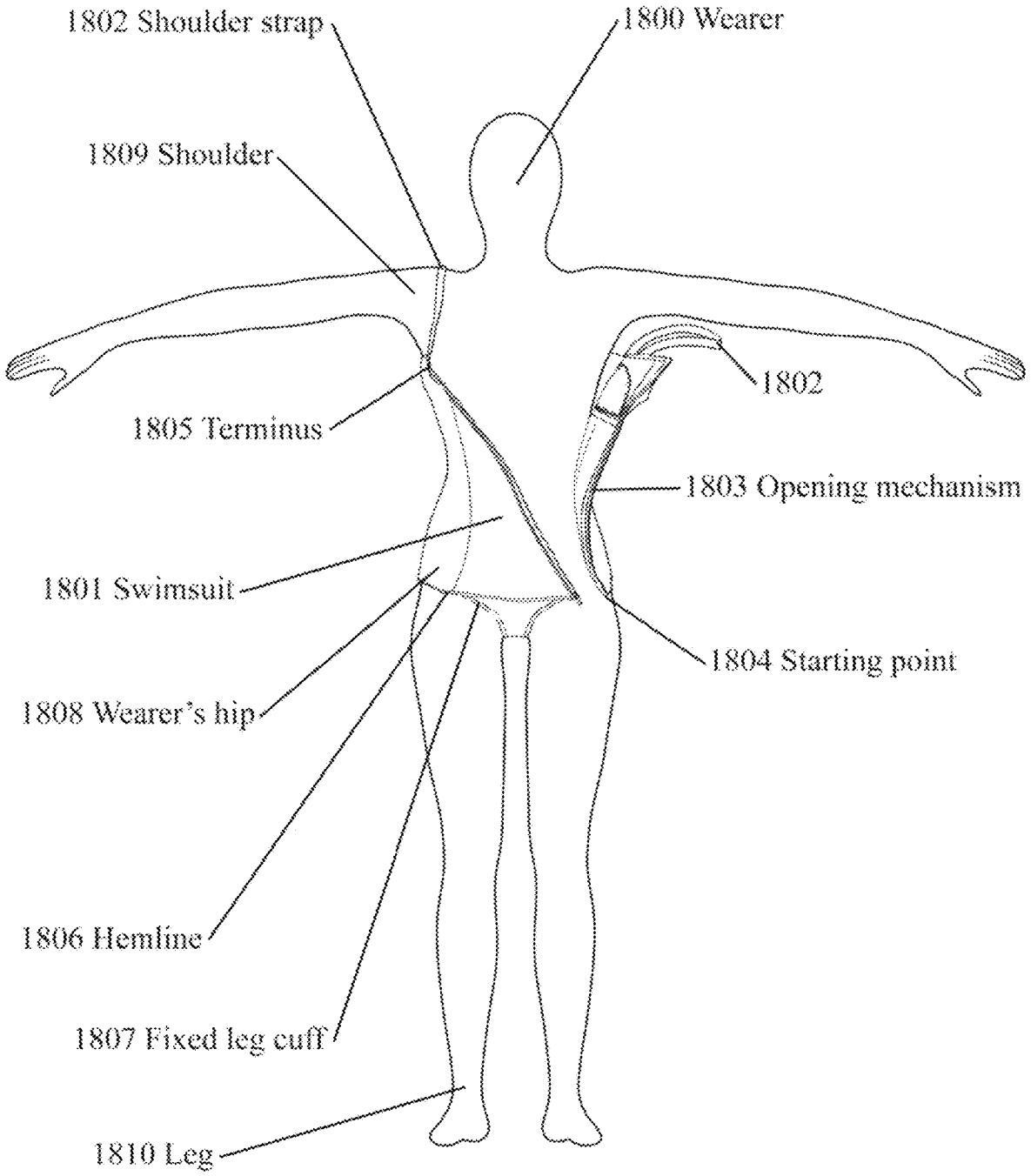
FIG. 18 is the front view of the second step for a wearer dressing in an exemplary embodiment swimsuit.

FIG. 18 is the second step for a wearer dressing in an exemplary embodiment swimsuit, also as a front view of the wearer 1800. The swimsuit 1801 is pulled to a position where the shoulder securing means, here a shoulder strap 1802, is placed on the wearer's 1800 shoulder 1809. The fixed leg cuff 1807 is pulled all the way over the wearer's leg 1810. The hemline 1806 of the swimsuit 1801 is in position and situated at the wearer's hip 1808. The opening mechanism 1803 is not attached at either the starting point 1804 or the terminus 1805.

Figure 19:
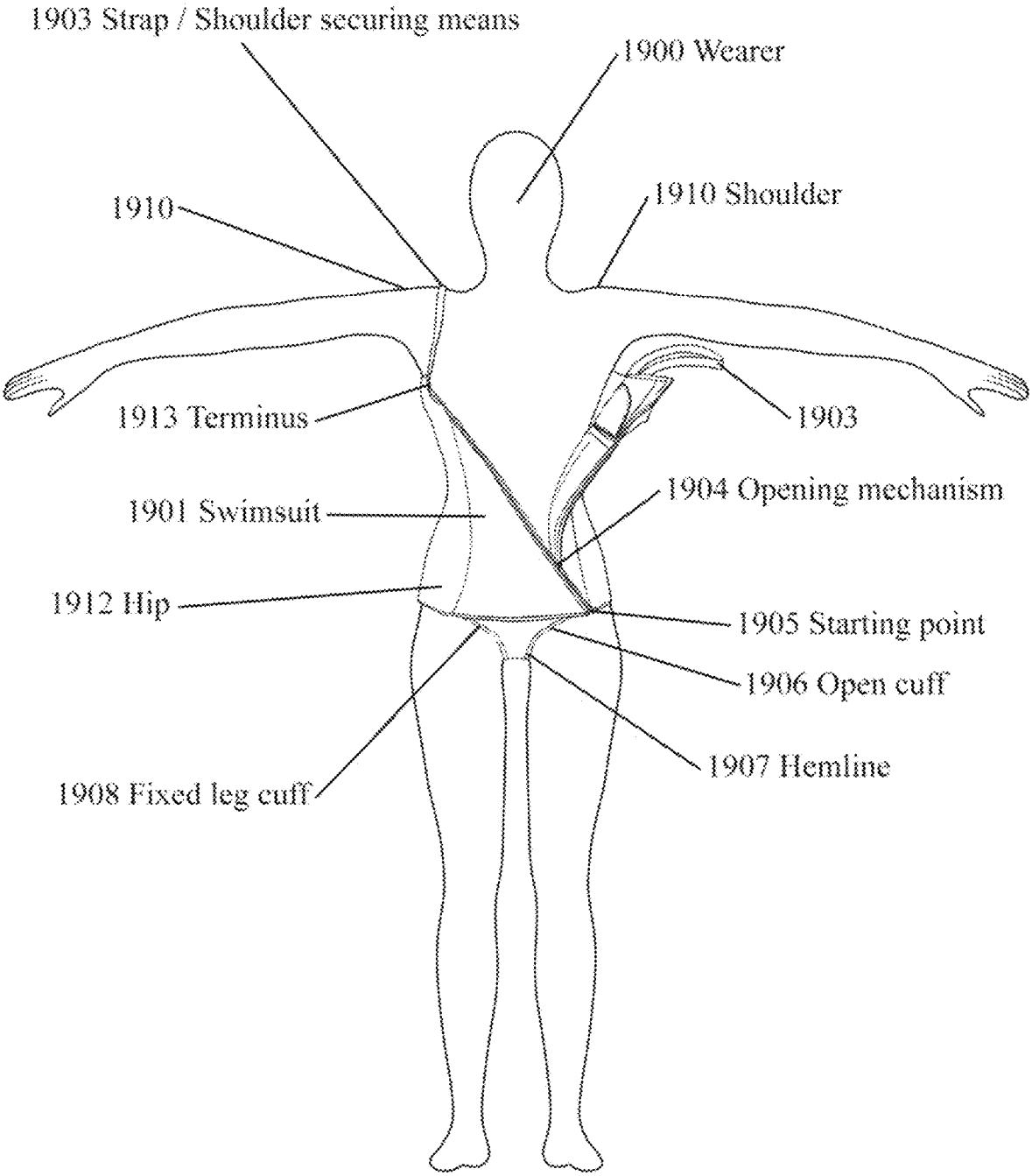
FIG. 19 is the front view of the third step for a wearer dressing in an exemplary embodiment swimsuit with a connection of the opening mechanism having been made.

FIG. 19 is the third step for a wearer dressing in an exemplary embodiment swimsuit, as a front view, with a connection of the opening mechanism having been made. This FIGURE continues the sequence described and shown in FIGS. 17 and 18. The wearer 1900 still has a shoulder securing means, a strap 1903, of the swimsuit 1901 over her shoulder 1910. A second strap 1903 situated on the same side of the suit 1901 and wearer 1900, is shown as free of the wearer's shoulder 1910, but it could be secured depending on preference or the specific shoulder securing means of the embodiment.

The fixed leg cuff 1908 remains in place as the hemline 1907 is at the wearer's hip 1912. The open leg cuff 1906 is now closed as the opening mechanism 1904 has been fastened at its starting point 1905. The dressing of the wearer 1900 in the suit 1901 will be complete when the opening mechanism 1904 has been fastened all the way to the terminus 1913.

Figure 20:
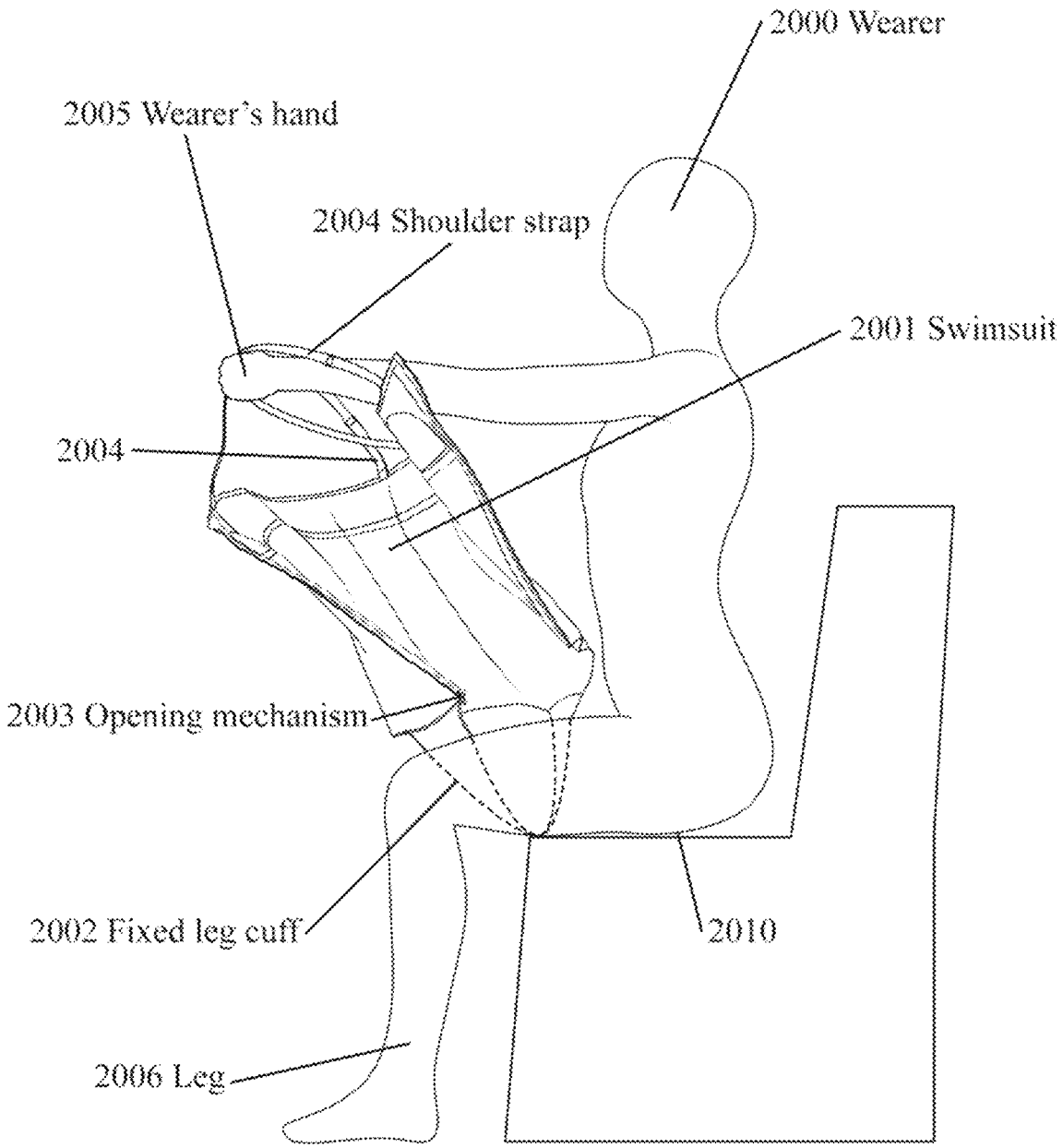
FIG. 20 is a side view of a wearer in a seated position, in a state of partial disrobement with an exemplary embodiment swimsuit, and holding the swimsuit away from her body.

FIG. 20 is a side view of a wearer in a seated position, in a state of partial disrobement with an exemplary embodiment swimsuit, holding the swimsuit away from her body. Due to the novel design of the present invention, as shown in the exemplary embodiment displayed in FIG. 20, a wearer 2000 can disrobe by unfastening the suit 2001 by separating the fastener of the opening mechanism 2003. While seated, the wearer 2000 can hold the suit in one hand 2005, while the suit is in total contact with the fixed leg cuff 2002. All that is required for the wearer 2000 is to remove the shoulder securing means 2004 and slide the suit's fixed leg cuff 2002 along the wearer's leg 2006. Due to the novel design, the wearer can be disrobed and seated on a bench 2010 or commode and maintain control of the suit 2001 and prevent its contact with the ground.

What is claimed is:

1. A swimsuit, comprising:

a torso-covering section extending from a bustline to a hemline, the torso-covering section defining a front panel, a back panel, a left panel, and a right panel, wherein the front panel, the back panel, the left panel, and the right panel are connected to form a continuous piece of the swimsuit adapted to wrap around a body of a wearer;

the hemline defining a crotch-covering section, a left leg cuff, and a right leg cuff; a first shoulder strap extending from the front panel to the back panel of the bustline, the first shoulder strap located on the left panel of the torso-covering section, wherein the first shoulder strap is connected to the front panel and the back panel on a left side of the torso-covering section;

a second shoulder strap extending from the front panel to the back panel of the bustline, the second shoulder strap located on the right panel of the torso-covering section, wherein the second shoulder strap is connected to the front panel and the back panel on a right side of the torso-covering section; and a fastener directly located on the front panel of the torso-covering section, the fastener extending from a first point located directly on a right side of the bustline of the front panel to a second point located directly on the left leg cuff of the hemline, wherein the first point is located directly adjacent to the second shoulder strap;

wherein the fastener extends diagonally from the first point to the second point only in one direction, which is from the right side of the bustline to the left leg cuff of the hemline.

2. The swimsuit according to claim 1, wherein the fastener is selected from the group consisting of: zippers, double-pull zippers, hook and loop fasteners, mushroom self-engaging fasteners, semi-circle buckles and straps, locking plastic clips, buttons, and snaps.

* * * * *